US012082632B2

(12) United States Patent
Forsell et al.

(10) Patent No.: US 12,082,632 B2
(45) Date of Patent: Sep. 10, 2024

(54) ARTICULATED CERVICAL SPINE AND NECK PROTECTION SYSTEM

(71) Applicant: Chiron Global Technologies IP Holdco Pty Ltd., Sydney (AU)

(72) Inventors: Justin Forsell, Haberfield (AU); David Pysden, Surry Hills (AU); Timothy Watson, Wellington (NZ)

(73) Assignee: CHIRON GLOBAL TECHNOLOGIES IP HOLDCO PTY LTD., Sydney (AU)

( * ) Notice: Subject to any disclaimer, the term of this patent is extended or adjusted under 35 U.S.C. 154(b) by 0 days.

(21) Appl. No.: 17/766,769

(22) PCT Filed: Oct. 2, 2020

(86) PCT No.: PCT/AU2020/000117

§ 371 (c)(1),
(2) Date: Apr. 6, 2022

(87) PCT Pub. No.: WO2021/108829

PCT Pub. Date: Jun. 10, 2021

(65) Prior Publication Data

US 2022/0386715 A1 Dec. 8, 2022

(30) Foreign Application Priority Data

Oct. 7, 2019 (AU) ..... 2019903774

(51) Int. Cl.
*A41D 13/05* (2006.01)
*A42B 3/04* (2006.01)
(Continued)

(52) U.S. Cl.
CPC ..... *A41D 13/0512* (2013.01); *A42B 3/0473* (2013.01); *A42B 3/105* (2013.01); *A63B 71/1291* (2013.01)

(58) Field of Classification Search
CPC .. A41D 13/0512; A42B 3/0473; A42B 3/105; A63B 71/1291
See application file for complete search history.

(56) References Cited

U.S. PATENT DOCUMENTS 4,590,622 A * 5/1986 Wolfe ..... A41D 13/0512 D29/101.3
4,638,510 A * 1/1987 Hubbard ..... B60N 2/80 2/6.1

(Continued)

FOREIGN PATENT DOCUMENTS

WO 1983000605 A1 3/1983
WO 1991003178 A1 3/1991
WO WO-2021108829 A1 * 6/2021 ..... A41D 13/0512

*Primary Examiner* — Khaled Annis
(74) *Attorney, Agent, or Firm* — Rivka Friedman

(57) ABSTRACT

An articulated cervical spine and neck protection system including an articulated cervical shroud assembly made of a rigid material and including an inner cervical shroud being approximately funnel-shaped and having a funnel portion and a neck portion, the inner cervical shroud is configured to be worn around a neck of a wearer, and the funnel portion configured to cradle a head of a wearer from below such that movement of the head of the wearer causes a corresponding movement of the inner cervical shroud; and an outer cervical shroud having a lower portion and an upper portion including a wall and is sized to sit concentrically around the neck portion of the inner cervical shroud so that the inner cervical shroud is partially nested within the outer cervical shroud that, when worn together, forms a ball-and-socket style articulation with the upper portion of the outer cervical shroud.

19 Claims, 8 Drawing Sheets

(51) Int. Cl.
*A42B 3/10* (2006.01)
*A63B 71/12* (2006.01)

(56) References Cited

U.S. PATENT DOCUMENTS 4,996,720 A * 3/1991 Fair ..... A63B 71/12 2/92
5,404,590 A * 4/1995 Monica, Jr. ..... A63B 71/1291 2/468
6,067,665 A * 5/2000 DePalma ..... A63B 71/1291 2/468
6,874,170 B1 4/2005 Aaron
7,371,221 B1 * 5/2008 Baker ..... A61F 5/055 602/18
8,281,419 B2 * 10/2012 Rietdyk ..... A41D 13/0512 602/5
8,562,551 B2 * 10/2013 Leatt ..... A41D 13/0512 602/18
8,898,822 B2 * 12/2014 Chambers ..... A41D 13/0512 2/468
9,861,152 B1 * 1/2018 Rumfelt ..... A63B 71/12
10,292,856 B2 * 5/2019 Thorgilsdottir ..... A61F 5/055
10,441,870 B2 * 10/2019 Corrigan ..... A63B 71/12
10,602,793 B1 * 3/2020 Williams ..... A63B 71/1291
11,076,646 B2 * 8/2021 Chambers ..... A42B 3/0473
2004/0216206 A1 * 11/2004 Schroth ..... A42B 3/0473 2/459
2007/0010771 A1 * 1/2007 Leatt ..... A61F 5/055 602/18
2007/0151004 A1 * 7/2007 Brassill ..... A63B 71/12 2/461
2010/0088808 A1 * 4/2010 Rietdyk ..... A42B 3/0473 2/467
2010/0286580 A1 * 11/2010 Leatt ..... A61F 5/055 602/18
2011/0010829 A1 1/2011 Norman
2012/0291189 A1 * 11/2012 Chambers ..... A61F 5/055 2/468
2013/0152288 A1 * 6/2013 Kerr ..... A41D 13/0512 2/468
2013/0185854 A1 * 7/2013 Bonomelli ..... A42B 3/0473 2/468
2015/0320124 A1 * 11/2015 Chua ..... A41D 13/1218 2/457
2016/0213086 A1 * 7/2016 Nagely ..... A41D 13/0531
2017/0143067 A1 * 5/2017 Garcia ..... A42B 3/0473
2017/0266536 A1 * 9/2017 Sciortino ..... A42B 3/0473
2017/0318889 A1 * 11/2017 Nagely ..... A42B 3/0473
2018/0110656 A1 4/2018 Ambring
2021/0106090 A1 * 4/2021 Zarreii ..... A42B 3/064
2022/0386715 A1 * 12/2022 Forsell ..... F41H 5/013

* cited by examiner

5/8

ARTICULATED CERVICAL SPINE AND NECK PROTECTION SYSTEM

COPYRIGHT NOTICE

This document is subject to copyright. The reproduction, communication and distribution of this document is not permitted without prior consent from the copyright owner, other than as permitted under section 226 of the Patents Act 1990.

FIELD OF THE INVENTION

The present invention relates to protective garments, and in particular to an articulated cervical spine and neck protection system for protecting the cervical spine and the soft tissues of the neck, and for reducing related injuries including concussion.

The invention has been developed primarily for use in full combat scenarios, including weapons-based combat, and combat-training scenarios, including in the defence forces, for law enforcement, or in martial arts competition or training including those involving weapons, and will be described hereinafter with reference to this application. However, it will be appreciated that the invention is not limited to this particular field of use.

BACKGROUND

The neck is a vulnerable part of the body, containing many vital structures. Added to this, the head forms a heavy weight perched on the long, slender, mobile cervical spine, retained in position by the muscles supporting it. The impact of injury to the neck and/or cervical spine can be significant, if not catastrophic and forces and impacts applied to the soft tissues (e.g. nerves, vasculature, the larynx, pharynx or trachea) of the neck and/or the cervical spine can in turn cause related injuries such as concussion or unconsciousness, or even be fatal.

Various solutions have been proposed to protect against cervical spine injury that might arise in various sports—notably football and motor sports. However, these are typically not suitable for protecting the cervical spine and soft tissues of the neck in full combat scenarios, including weapons-based combat, military and law enforcement combat and martial arts (and training for the same).

This is because (as found in a study published in the published in the *British Medical Journal*) the kinematics of "takedown" techniques that use a combatant's weight and the weight of the opponent to force the opponent onto the ground and the magnitude of the forces involved may resemble those of a motor vehicle collision, and exceed the threshold levels that can result in cervical injury. Further, weapon strikes delivered at full force by trained close-quarter combat specialists (such as a rifle butt strike to the throat of an opponent) can also exceed the threshold levels that can result in cervical injury, not to mention potentially fatal injury to soft tissue of the neck (e.g. vagus nerve, carotid artery, pharynx/larynx, trachea).

Traditional helmets as used in many high risk sports (e.g. motor sports, football) offer limited or no protection against neck or cervical spine injury—and particularly not in weapons-based full force contact martial arts or military, law enforcement, security and corrections combat scenarios requiring protection from violent attacks, explosives and/or projectiles.

Various helmets and shoulder assemblies have been proposed to address the risk of cervical spine injury but typically they leave the soft tissues of the neck completely exposed and also restrict mobility in a manner that makes them unsuitable for use in real combat or realistic combat training, leave parts of the neck and throat unprotected that can be exploited by attackers who can deploy weapons or projectiles into unprotected parts to cause harm to the wearer, and do not gradually decelerate forces and impacts to the cervical spine thereby increasing whiplash and concussion risk.

For example, U.S. Pat. No. 5,930,843 to KELLY describes a helmet and shoulder harness assembly that claims to provide cervical spine protection. The helmet is connected to the shoulder harness assembly by a pair of "helmet support assemblies" akin to trunnions—one on each side of the helmet.

The helmet and shoulder harness support assembly of KELLY suffers the disadvantage that it seeks to protect the cervical spine by having two upright support assemblies (one on each side of the long axis of the neck) to support the helmet from the shoulder harness. This is a disadvantage because:

(a) the neck remains exposed at the front and back, which leaves the throat and soft tissues/major arteries of the neck unprotected from blows, weapons and/or projectiles during combat. Further, cutouts on the front and back of the shoulder protector to allow the head to nod forwards and backwards (movement that would be prevented by contact of the bottom of the helmet with the top of the shoulder protector) limit the ability of the helmet to limit hyper-extension or -flexion;

(b) the upright support assemblies on each side of the helmet convert a load distributed across the helmet to a point load (borne by the two upright support assemblies) onto the shoulder harness. This may limit the degree of compressive force that the assembly can sustain. It also gives rise to potential for one or both support arms of the support assemblies to snap during combat, as a result of significant compressive force, or a high velocity lateral impact to one or both support arms;

(c) the use of only two upright supports to support the helmet may further limit the ability to deal with significant lateral eccentric loading on the cervical spine—that is, significant compressive forces applied laterally to the long axis of the neck. These lateral eccentric forces may occur, for example, if the wearer is hit on the head with a weapon (e.g. a sword or a heavy blunt weapon) laterally to the centre of the head.

Another disadvantage of the helmet assembly of KELLY is that the trunnion structure of the helmet support assembly substantially prevents tilting of the head sideways (lateral neck flexion). This is a significant limitation in mobility for realistic combat situations and makes the head and shoulder harness assembly of KELLY unsuitable for use in combat such as real combat, close quarter combat in military, law enforcement, security or corrections scenarios, full force contact martial arts combat including weapons-based combat or realistic combat-training where head mobility is vitally important to avoid, deflect, roll with or absorb strikes and other impacts to the head.

By preventing lateral neck flexion, KELLY may also reduce the visual field of the wearer, which is also vitally important in combat scenarios. Studies have shown that we move our heads to fixate on an object of interest presented peripherally as well as our eyes, even when we are capable of fixating the object with eye movement alone. A study investigating visual perceptual effects of head direction shows that if we rely on eye movement alone (rather than moving the head in addition to moving the eyes), the time required to detect certain types of target can increase, meaning that combat reaction time is also increased, in turn increasing risk of being stuck or injured. In other words, a difference between head and eye directions can interfere with visual processing. In a military, law enforcement, security or corrections combat scenario or a combat training or sport scenario this difference can be vital, even lethal, to the wearer.

A study investigating the influence of cervical spine mobility on motor performance has found that restricting cervical spine mobility appears to lead to lower motor performance and a reorganization of the anticipatory postural adjustments (the preparatory phase of movements). This suggests that a device such as KELLY that restricts cervical spine mobility can adversely impact overall motor performance, which makes KELLY unsuitable for use in realistic combat scenarios.

There remains a need for cervical spine and neck protection system to protect against cervical spine injury without unduly restricting cervical spine mobility, and that can also protect all vital organs, nervous system pathways and blood vessels within the neck.

U.S. Pat. No. 6,968,576 to McNEIL provides a helmet with cervical spine protection that attempts to provide greater mobility than KELLY. The helmet of McNEIL allows free movement except when a shock absorbing mechanism is activated. The shock absorbing mechanism of McNEIL includes shock-absorbing devices connected by tubing to a valve. An impact on the helmet activates the valve to block the flow of liquid in the tubing, thereby stiffening the shock absorbing devices and transmitting the impact force to the shoulders of the player.

McNEIL shares the disadvantages of KELLY in that the helmet is supported from the shoulders only at two points. It has the added disadvantage of relying on liquid in a tube to provide the shock-absorbing mechanism. Should the valve not activate or the tube be dislodged or damaged (as may occur in combat—particularly, weapons-based or other forms of high impact combat including those with repeated strikes), the shock-absorbing mechanism would fail and the wearer left without any cervical spine protection.

The device of McNEIL suffers the further disadvantages that:

(a) it offers either neck mobility or cervical spine protection, not both at the same time—any cervical spine protection comes at a cost to mobility;

(b) the cervical spine protection mechanism is a single-use mechanism that needs to be re-set after each deployment, making it unsuitable for real combat, close quarter combat in military, law enforcement, security or corrections scenarios, full force contact martial arts combat including weapons-based combat or realistic combat-training, or in any other circumstances where a wearer may encounter repeated blows or risk injury from repeated or serial movements rather than a single event;

(c) at all times, the neck and the structures within it remain exposed.

For the above reasons, McNEIL fails to cater to the full spectrum of cervical spine risk posed during real combat, close quarter combat in military, law enforcement, security or corrections scenarios, martial arts combat including weapons-based combat or realistic combat-training, while simultaneously providing sufficient movement for combat.

U.S. Pat. No. 4,825,476 to ANDREWS provides a head, neck and shoulder protective device particularly adapted for football. Despite claiming to provide "free movement" of the head and neck up and down and from side to side, the ANDREWS device limits sideways tilting or bending of the neck. This limitation is caused by upwardly projecting side flanges on each side of a circular helmet housing. The helmet sits on the circular housing and the upward side flanges fit into corresponding recessed portions on each side of the helmet. The helmet is then held in place in the housing by a screw (pivot mount) on each side passing through to the side flange around the level of the ear hole. The helmet of ANDREWS is thus mounted on the helmet housing so that it is able to pivot freely around the axis of the screws at ear-hole level.

The helmet housing sits on top of a rotatable ring mounted onto rollers on a horizontal annular track that has a central opening large enough for a head to pass through. The annular track is part of the shoulder protector. In ANDREWS, free motion of the head from side to side and up and down is provided by the rotatable ring and the pivot mounts holding the helmet onto the helmet housing. Optional stops may be used to limit rotation. However, ANDREWS suffers the disadvantages that:

i. as with the KELLY and McNEIL devices, sideways tilting or bending of the neck is limited, making it unsuitable for real combat, close quarter combat in military, law enforcement, security or corrections scenarios, full force contact martial arts combat including weapons-based combat or realistic combat-training;

ii. the side flange(s) and/or pivot mount(s) may fail under significant (e.g. high velocity projectile or explosive) force, leaving the cervical spine unprotected or insufficiently protected;

iii. the helmet housing sits on top of the annular track, which is of a diameter that must be large enough for a head to pass through. This means the diameter of the helmet housing (and thus the base of the helmet) is dictated by the diameter of the largest part of the skull. This makes the fit around the neck:

a. very loose, potentially limiting the device's effectiveness in preventing cervical spine injury;

b. so wide compared to the shoulders that it would limit free shoulder movement as required for realistic combat or many combat and non-combat sports making it unsuitable.

All of the above helmet and shoulder assemblies suffer the common disadvantage that they do not gradually decelerate forces and impacts to the cervical spine that can lead to whiplash and concussion risk. The limits on unsafe movement activate at one or more thresholds rather than gradually increasing resistance in response to increasing injury-causing force. The more gradual resistance of force is an advantage in movements where organs and bones can continue to move inside the body even when the body stops. An example would be where the brain moves inside the skull and brain injury can occur where it touches the inside of the skull. A more gradual resistance to loads reduces this kind of risk and its consequences. As such, protective garments that allow for gradual deceleration of impacts or forces, rather providing a sudden stop to movement once a threshold is crossed, have an advantage over ones that suddenly stop movement.

It would also be an advantage to have a protective garment that could transfer a load borne by the neck/cervical spine away to a less vulnerable area. U.S. Pat. No. 8,562, 551B2 to LEATT provides a neck brace that claims to prevent most types of neck injury by transmitting impact loads imposed on the brace to the back and/or chest. This is achieved by having a column extend from the back of the LEATT neck brace down the back of the wearer, which has cushioning along its vertical edges for transmitting loads imposed on the brace to the back on each side of the spine. A column extending down from the front of the neck brace and extending down the chest of the wearer may also transmit impact loads from the brace to the chest.

When worn with a full face helmet that extends around the head to just below the level of the chin, axial forces can be dissipated when a gap between the lower edge of the helmet and the upwardly facing surface of the neck brace (needed to allow head movement) closes up, causing the edge of the helmet to strike the brace. Lateral rotation is inhibited by a strap that extends between the brace and the helmet. The strap causes lateral rotation of the head to be converted into flexion.

The LEATT has extensions that protrude from the top (upper surface) of the neck brace—in both the rearward and forward directions. These extensions limit tilting of the helmet in the rearward and forward directions, respectively, when the bottom of the helmet hits the relevant extension. However, LEATT does not limit lateral flexion—other than perhaps the same strap that limits lateral rotation of the helmet. As such, the ability of the LEATT brace to impede lateral loads on the cervical spine is limited and comes at the cost of mobility.

The LEATT brace therefore suffers the disadvantage that it is designed to be spaced from the bottom of a helmet when worn with a helmet, which means that a clearance or gap exists between that upper surface of the neck brace and the lower part of the helmet—this is dangerous for real combat applications as parts of the neck (and thereby the underlying soft tissue) and cervical spine are left unprotected against blows, projectiles and/or weapons.

Further, the neck brace of LEATT is designed to allow for certain zones to be weaker than others—that is, zones that are collapsible or able to be fractured by impact from the lower rim of the helmet on the brace. This is to absorb shocks applied to the brace by the helmet (like a crumple zone of a car). However, this makes the brace of LEATT unsuitable in combat or in any scenario in which the brace may be required to take multiple impacts, strikes or attacks rather than a one-off impact such as in a motor vehicle accident.

Further disadvantages of LEATT include:

1. it is not designed for gradual deceleration of impacts or forces, instead it inhibits movement only once a single threshold is exceeded and only protects when worn with a full-face helmet;
2. it is not designed for shear or diagonal impacts or forces but is limited to dealing with loads that cause forward or backward tilting of the head. As such, LEATT is only able to transfer away loads in these two directions and not the multitude of directions (and simultaneous loads) that may arise in realistic combat scenarios;
3. it is designed to stop lateral rotation using a strap which extends between the neck brace and the helmet—this strap will not cause deceleration but will instead immediately stop the head from rotating which can cause concussive impacts to the wearer and if the strap is damaged its protection will fail. Further, the strap must be of a limited length for safety and would not work if it is too long. Too short, however, and it overly restricts not only lateral rotation but also lateral flexion, which makes it unsuitable for combat.

AUSTRALIAN patent no. AU2011201521B2 to HOPKINS et al provides a neck brace that is an improvement over the LEATT neck brace. The HOPKINS brace sought to better address injuries caused by very rapid decelerations (e.g. during motor sports) than the LEATT brace. A disadvantage of the earlier LEATT brace identified in HOPKINS was that the LEATT brace allowed the head and helmet to travel too far forward relative to the brace during rapid deceleration—causing strain on the upper cervical spine as the helmet rotated forward. In other words, the helmet and neck could cantilever forward over the cervical spine, causing injury.

The HOPKINS brace further includes a strap or tether of very high tensile strength attachable to the helmet in at least two spaced locations and that also releasably attaches the rear of the ring of the neck brace. Forward rotation of the helmet puts the tether under tension to prevent further rotation by restraining the helmet from moving further away from the back of the ring. Reliance on a single strap or tether to prevent forward projection (cantilevering) of the head over the cervical spine suffers the disadvantage that in the event of failure, the wearer's cervical spine is left unprotected. Also, there is a risk of rebound from extreme forces, where the tether snaps the head back like a sling-shot in response to an extreme deceleration.

The HOPKINS brace is designed to reduce injury in motor sports but does not provide adequate protection to the cervical spine and soft tissues of the neck in combat scenarios because it again relies on interaction with a full-face helmet to provide any protection. Without the full-face helmet, the HOPKINS brace does not protect the cervical spine, other than against over-extension of the neck (in a rearwards direction). It also offers no protection to the soft tissues of the throat or sides of the neck.

The helmet is tethered by a strap that extends from the back of the ring of the neck brace to two points on the helmet. As such, the HOPKINS brace shares the disadvantage of other prior art protective garments that it is not designed for gradual deceleration of impacts or forces (here, forward rotation or cantilevering of the head over the front of the cervical spine), rather providing a sudden stop to movement once a threshold is crossed.

The helmet and neck brace of HOPKINS are also spaced apart, providing a gap in the physical barrier protecting the soft tissues of the neck, and resulting in a gap to coverage along the cervical spine. The HOPKINS brace does not improve the protections against excessive lateral loading or lateral rotation offered by the LEATT brace, and so continues to suffer the same disadvantages as LEATT in combat scenarios. Further the use of a single strap to prevent forward cantilevering of the skull over the cervical spine does not provide sufficient protection against shear loads that could be imposed on the cervical spine from the rear during combat scenarios, particularly weapons-based combat.

U.S. Pat. No. 6,058,517 to HARTUNIAN provides a sports neck brace made of foam for players in a contact team sport. The object of the HARTUNIAN neck brace is to prevent cantilevering of the head about the top surface of the neck brace, which can exaggerate forces applied to the neck and result in serious injury. This is achieved by fastening the neck brace about a wearer's neck to provide 360 degrees of cushioning—"capturing" the base of the helmet within the brace to minimise the possibility of the helmet (and with it the wearer's head) from cantilevering when in contact with the brace.

However, the HARTUNIAN neck brace is "self contained" in that it is not fastened to anything and sits freely in a neck opening between two shoulder pads. It has a contour on its lower surface so there is no resistance to movement between the neck brace and underlying shoulder pads, so the neck brace can rotate freely on top of the shoulder pads. With compression, however, the neck brace digs into the shoulder pads and friction between the two surfaces acts to reduce rotation of the neck brace.

HARTUNIAN suffers from disadvantages in that:

(a) it offers no protection to the cervical spine against excessive rotation unless rotational forces on the neck brace are also accompanied by axial (compressive) forces;

(b) the foam neck brace of HARTUNIAN is unsuitable for real combat, close quarter combat in military, law enforcement, security or corrections scenarios, full force contact martial arts combat including full contact weapons-based combat or realistic combat-training including combat with multiple strikes to the same location from real sharp or edged weapons, blunt force strikes, weapons and projectiles;

(c) its design allows some freedom of movement prior to contact but once the foam compresses and digs into shoulder pads this reduces rotation and offers little protection against other simultaneous loads. This limits its use in combat scenarios, which require ongoing agility and the ability to move while being protected from multiple attacks and impacts from multiple angles;

(d) the free-floating nature of the neck brace means the neck brace may be forced up or down along the neck from its intended position (for example as could arise in grappling during close quarter combat) limiting the ability of the neck brace to make contact with the shoulder pads below (e.g. if it loses contact with the shoulder pads) or with a helmet above, and potentially leaving different parts of the neck and cervical spine completely exposed during combat;

It would be useful to have a device that could provide protection to the cervical spine as well as to the soft tissues of the neck/throat in combat scenarios.

U.S. Pat. No. 10,441,870 to CORRIGAN describes protective articles (including spinal support devices) that claims to protect against injury to the head and neck in military operations. Relevantly, CORRIGAN includes a neck support element that is a penannular collar member anatomically complementary with the neck of a wearer and that contains an elastomeric or force-reactive material positioned around the rear and sides of wearer's neck.

The support elements of CORRIGAN are made to be used with compression elements and gripping elements. The gripping element can be made of a material to prevent slipping or shifting of the protective article when worn (due to friction with skin). The compression element is a compression garment that acts to provide stress support, load transfer and/or fatigue relief to the wearer. It achieves this by exerting force on muscle, bone or a joint of the wearer—to the area underlying the compression element.

The support elements are made of a gel or foam that comprises a shear-thickening non-Newtonian material that increases in viscosity under shear stress or a force-reactive or foam matrix that includes rate-sensitive material (e.g. non-Newtonian fluid) to provide stress relief and load transfer, and increasing resistance to movement with increasing force of the movement.

CORRIGAN suffers the following disadvantages in combat scenarios:

(a) non-Newtonian materials need a percussive impact to harden and are only protective when in a solid state, which is brief;

(b) non-Newtonian materials do not respond to slow forces (with or without weapons) that can harm or kill in combat. As such, they cannot stop a slow sharp-point force that is applied slowly with, say 90 kg body weight behind it—this can and does happen in real combat e.g. two combatants grappling with weapons, or a ligature/cord wrapped around the neck and slowly constricted to choke (or snap the neck of) an opponent;

(c) in combat scenarios where the loads may be extreme and come from multiple directions, stiffening of non-Newtonian materials (and their swift return to a non-rigid state) at multiple locations within the compression garment may unintentionally limit or allow movement (and remove protection) at different locations simultaneously, resulting in unpredictable behaviour in combat;

(d) the transfer of loads from the support element to the area of the body immediately underlying it offers limited protection against significant loads applied to vulnerable parts of the body (e.g. cervical spine or soft tissues of the neck);

(e) the reliance on non-Newtonian materials also dictates that the neck support device (collar) of CORRIGAN is penannular—with a gap in coverage along the front of the throat. This is because if the collar completely encircled the neck, the sudden stiffening of the collar could pose a strangulation risk. The permanent exposure of the throat, however, makes CORRIGAN unsuitable for full combat scenarios.

The present invention seeks to provide an articulated cervical spine and neck protection system that allows good movement while protecting the cervical spine and soft tissues of the throat and neck against risks commonly associated with full contact sports and real combat scenarios, including weapons-based combat.

It is to be understood that, if any prior art information is referred to herein, such reference does not constitute an admission that the information forms part of the common general knowledge in the art, in Australia or any other country.

SUMMARY

According to a first aspect, the present invention provides an articulated cervical spine and neck protection system for protecting the cervical spine and soft tissues of the neck comprising an articulated cervical shroud assembly made of a rigid material, wherein the articulated cervical shroud assembly includes:

(a) an inner cervical shroud being approximately funnel-shaped and having a funnel portion and a neck portion, wherein the inner cervical shroud is configured to be worn substantially around a neck of a wearer, and wherein the funnel portion of the inner cervical shroud is configured to cradle a head of a wearer from below such that movement of the head of the wearer causes a corresponding movement of the inner cervical shroud, and (b) an outer cervical shroud having an upper portion and a lower portion, wherein the upper portion of the outer cervical shroud includes a wall and is sized to sit concentrically around the neck portion of the inner cervical shroud so that the inner cervical shroud is partially nested within the outer cervical shroud; and wherein when the inner cervical shroud and the outer cervical shroud are worn together, the neck portion of the inner cervical shroud forms a ball-and-socket style articulation with the upper portion of the outer cervical shroud, said ball-and-socket articulation allowing the inner cervical shroud to overlap with the outer cervical shroud for added protection around the neck of the wearer, while permitting movement of the inner cervical shroud relative to the outer cervical shroud in ball-and-socket fashion.

Preferably when assembled together, the articulated cervical shroud assembly is configured to extend vertically around the neck of the wearer, including at its sides, between an upper plane defined by the occipital bone region and mandible region of the wearer and a lower plane defined by the trapezius muscle region and the pectoral muscle region of the wearer, thereby protecting the neck of the wearer along its full length while permitting movement.

Further preferably, the outer cervical shroud has an inclined upper surface, configured to incline in a direction from a front of the neck to a back of the neck of the wearer when the outer cervical shroud is worn by the wearer, wherein the inclined upper surface of the outer cervical shroud has an upper flange, and wherein the upper flange of the outer cervical shroud is configured to progressively bite against the funnel portion of the inner cervical shroud as the head of the wearer moves such that progressive biting of the upper flange of the outer cervical shroud against the funnel portion of the inner cervical shroud progressively limits movement of the inner cervical shroud relative to the outer cervical shroud.

Further preferably still, each of the components of the articulated cervical spine and neck protection system is made of a material with sufficient rigidity to transfer at least some of a force applied to a first component vertically down along the body of a wearer.

DETAILED DESCRIPTION

The invention thus provides an articulated cervical spine and neck protection system that overcomes the problem of prior art protective garments or to at least provide an alternative by allowing good movement while protecting the cervical spine and soft tissues of the throat and neck against risks commonly associated with full contact sports and real combat scenarios, including weapons-based combat.

BRIEF DESCRIPTION OF THE DRAWINGS

For a better understanding of the invention and to show how it may be performed, a preferred embodiment will now be described, by way of non-limiting example only, with reference to the accompanying drawings.

Notwithstanding any other forms which may fall within the scope of the present invention, preferred embodiments of the present invention will now be described, by way of examples only, with reference to the accompanying drawings in which:

In FIG. 3A the cervical shroud assembly 200 does not include a helmet portion, but in an embodiment would include a helmet portion. In FIG. 3B, the articulated cervical shroud assembly 200 is shown with a helmet portion 300 but could also be used without a helmet portion;

In FIG. 4B, the articulated cervical shroud assembly 200 includes a helmet portion 300. The arrows indicate how the inner cervical shroud 210 can move relative to the outer cervical shroud 220 in ball-and-socket fashion.

FIG. 5A to 5E are front views of the outer cervical shroud 220 with the inner cervical shroud 210 moving in different directions. FIGS. 5B and 5C are front views of the outer cervical shroud 220 with lateral flexion (bending) of the inner cervical shroud 210 with and without rotation, respectively. FIGS. 5D and 5E are front views are front views of the outer cervical shroud 220 showing forward flexion of the inner cervical shroud 210 with rotation in different directions. FIG. 5F is a side view of the outer cervical shroud 220 with the inner cervical shroud 210 rotating around the longitudinal axis of the cervical spine. FIGS. 5G and 5H are side views of the articulated cervical shroud assembly 200 of FIG. 2 in cross section showing exemplary backward tilting (extension) in FIG. 5G and forward tilting (flexion) in FIG. 5H of the inner cervical shroud 210 relative to the outer cervical shroud 220. FIGS. 5I and 5J are the same as FIGS. 5G and 5H, but where the articulated cervical shroud assembly 200 includes a helmet portion 300.

FIG. 8A shows a cervical shroud assembly 200 that has the same features of that of FIG. 1 but where the inner cervical shroud 210 includes a helmet portion 300. FIG. 8B shows a cervical shroud assembly 200 that has the same features of FIG. 2 (with projection 270 on the outer surface of the outer cervical shroud 220).

FIG. 10 shows different arrangements of a securing device 290 for securing the articulated cervical spine and neck protection system 100 in position on a wearer.

In FIG. 10A, the cervical shroud assembly 200 includes a helmet portion 300. In FIG. 10B, the cervical shroud assembly 200 does not include a helmet portion but includes a securing device 290 such as a harness that secures the articulated cervical spine and neck protection system 100 to the head of the wearer. In FIG. 10C, the embodiment of FIG. 10A is shown with an alternative securing device 290 in the form of a harness that secures the cervical shroud assembly 200 to the torso. FIG. 10D shows an articulated spinal spine and neck protection system 100 that includes both the head harness of FIG. 10B and the torso harness of FIG. 10C.

DESCRIPTION OF EMBODIMENTS

Figure 1A:
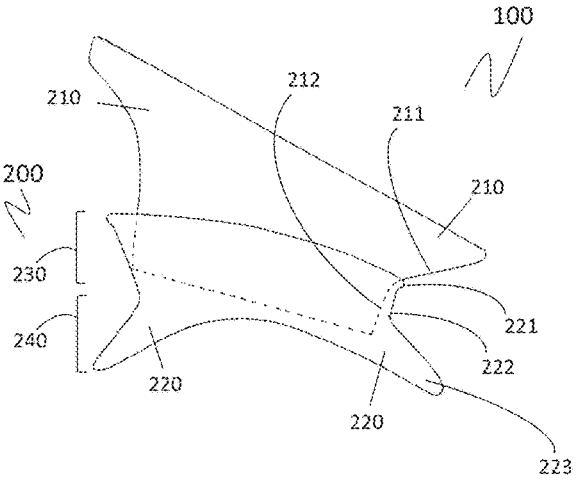
FIG. 1A is a side view of the articulated cervical spine and neck protection system 100 according to an embodiment, shown schematically in cross section. The articulated cervical spine and neck protection system 100 includes an articulated cervical shroud assembly 200 comprising an inner cervical shroud 210 and an outer cervical shroud 220. The outer cervical shroud has an upper portion 230 and a lower portion 240.
Figure 2A:
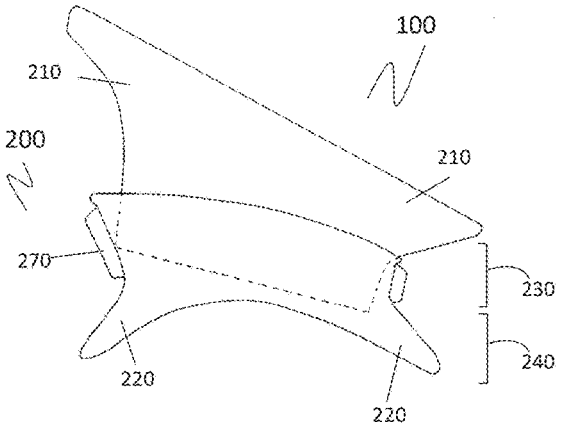
FIG. 2A is a side view of an articulated cervical spine and neck protection system 100 according to an embodiment, in which the articulated cervical spine and neck protection system 100 includes an articulated cervical shroud assembly 200 comprising an inner cervical shroud 210 and an outer cervical shroud 220. The outer cervical shroud 220 in this embodiment includes a projection 270 on its outer surface. All other features are the same as the embodiment of FIG. 1.

The invention provides a new or alternative cervical spine and neck protection system for use in real combat or combat sport scenarios (including with real weapons). The articulated cervical spine and neck protection system comprises an articulated cervical shroud assembly that is configured to sit around the neck and to dissipate forces that may cause injury to the cervical spine from axial loads or from excessive lateral movement, rotation, hyperflexion or hyperextension while allowing the cervical spine a full range of functional (safe) movement.

This is achieved by the articulated cervical spine and neck protection system having an articulated cervical shroud assembly made of a rigid material that sits around the neck of a wearer and protects both the cervical spine and soft tissues of the neck (e.g. vasculature, musculature, nerves and structures such as the larynx and pharynx). The articulated cervical shroud assembly:

(a) is made of two parts (inner cervical shroud and outer cervical shroud) that articulate in ball and socket fashion with each other to provide a wide range of safe movement, which is essential in combat scenarios;

(b) when the two parts are assembled, the articulated cervical shroud assembly covers (protects) the entire length of the neck—from the occiput/upper cervical spine region down to the lower cervical spine/trapezius and pectoral muscle region;

(c) when assembled, the two parts overlap along a significant proportion of the length of the articulated cervical shroud assembly, providing added protection against weapons and/or projectiles at any angle;

(d) when assembled, the two parts are designed to resist axial forces—due to the inner cervical shroud having a funnel-shaped portion that progressively increases in diameter. When an axial load is received on the inner cervical shroud moving it downwards, the increasing diameter of the funnel portion of the inner cervical shroud eventually gets too big for the outer cervical shroud and therefore downward passage of the inner cervical shroud is progressively stopped;

(e) when assembled, the two parts are also designed to resist excessive lateral, rotational or flexion or extension of the cervical spine. This is achieved through the outer cervical shroud having an inclined upwardly facing surface (with a flange) at its upper portion. The upper portion inclines from the front to the back portion of the outer cervical shroud, which enables the outer cervical shroud to progressively bite or engage with the funnel portion of the inner cervical shroud and so to progressively resist loads from lateral, forwards or backwards bending and from rotational forces on the cervical spine.

In embodiments, the articulated cervical spine and neck protection system may further include one, two or all three of the following components in the following order:

(a) a helmet portion (designed to fit to the inner cervical shroud or a helmet that can be retrofitted to connect it to the inner cervical shroud) for improved protection from axial forces, plus protection of the head and skull from projectiles/weapon strikes;

(b) a chest-and-back-plate assembly for transfer of forces from the cervical spine region to the lower back/abdomen of the wearer;

(c) a lower torso lumbar belt for transfer of forces from the cervical spine region to the hip area of the wearer.

In all embodiments, the articulated cervical spine and neck protection system (and all components) are made of a material that is sufficiently rigid to allow force transfer from one component to the next. The rigid material must also be suitable to resist forces from weapons (including sharp-edged weapons) and ballistics (projectiles).

Further, from the articulated cervical shroud assembly downwards, each of the components of the articulated cervical spine and neck protection system articulates with the next—that is, each can move relative to the "next" component. In other words, the inner cervical shroud articulates with the outer cervical shroud, the outer cervical shroud articulates with the chest plate and with the back plate, and the chest plate and back plate articulate with the lower torso lumbar belt through an articulated coupling means. This allows forces applied to the cervical shroud to be progressively transferred away to less vulnerable parts of the body (e.g. to the hips). In combat scenarios, where loads on the soft tissues of the neck and/or cervical spine can be substantial, this is an important way to mitigate the risk of trauma, injury or death.

The range of motion for the cervical spine in a typical, healthy adult is:

(a) Lateral bending of the neck (bringing the ear toward the shoulder): up to around 20 to 45 degrees left or right;

(b) Rotation (turning the head to the left or the right around the axis of the cervical spine): up to around 70 to 90 degrees in either direction (c) Flexion of the neck (moving the chin forward, toward the sternum): up to around 70 to 90 degrees; and (d) Extension of the neck (trying to point up with the chin): up to around 55 to 70 degrees.

The articulated cervical shroud assembly 200 keeps movement within a safe, functional range but stops excessive movement that increases the risk of injury—particularly when the forces applied on the cervical spine are significant and/or multiplanar, such as in contact sport or combat scenarios. For example, a typical adult with a normal range of neck movement, can rotate the head up to 70 to 90 degrees in either direction horizontally. The articulated cervical shroud assembly 200 prevents:

(a) lateral bending of the neck (movement of the ear towards the shoulder) beyond about 20 to 45 degrees (the typical limit to movement in a healthy adult);

(b) head rotation beyond about 70 to 90 degrees left or right horizontally;

(c) flexion of the neck (movement of the chin towards the sternum) beyond around 70 to 90 degrees vertically; and/or extension of the neck (movement of the chin, pointing up) beyond about 60 to 80 degrees vertically.

The articulated cervical shroud assembly 200 reduces the possible range of movement only at the far ends of the range of functional movement, in any given direction. As such it is also able to protect against complex, multiplanar forces in which forces are applied from different directions around the same time, sometimes resulting in movement between cervical vertebrae. However, the articulated cervical shroud assembly 200 does not interfere with the normal range of functional movements, which is required in combat and/or contact sport scenarios. Further, the articulated cervical shroud assembly 200 protects the cervical spine against complex, multiplanar movements in which the line of forces may result in forces being applied to the cervical vertebrae in different directions at the same time. These movements between cervical vertebrae can cause injury. Prior art helmet assemblies with cervical spine protection features focus on uniplanar forces.

Referring to the drawings, it will be appreciated that in the different figures, corresponding features have been denoted by corresponding reference numerals.

FIG. 1 illustrates an articulated cervical spine and neck protection system 100 according to a preferred embodiment. The articulated cervical spine and neck protection system 100 comprises an articulated cervical shroud assembly 200.

Figure 1B:
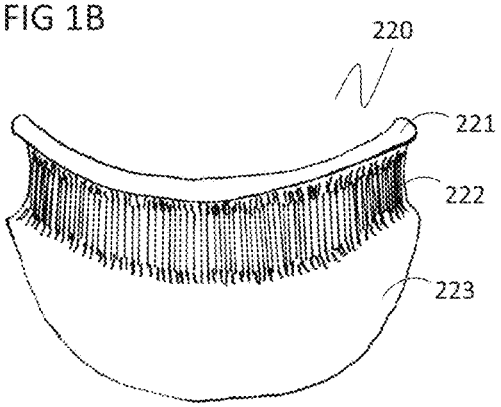
FIG. 1B is a front view of the outer cervical shroud 220 of the embodiment of FIG. 1A, showing the upper flange 221, lower extension 223 and wall 222 of the front portion of the outer cervical shroud 220.
Figure 2B:
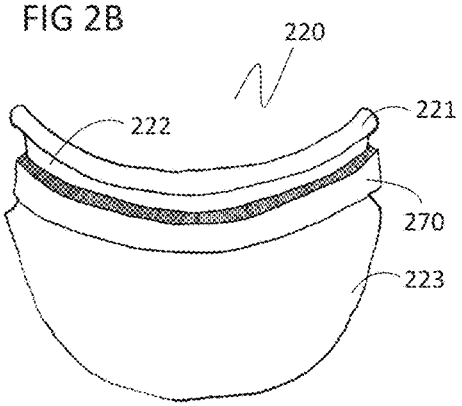
FIG. 2B is a front view of the outer cervical shroud 220 of the embodiment of FIG. 2A, showing the upper flange 221, lower extension 223 and wall 222 of the front portion of the outer cervical shroud 220.
Figure 1C:
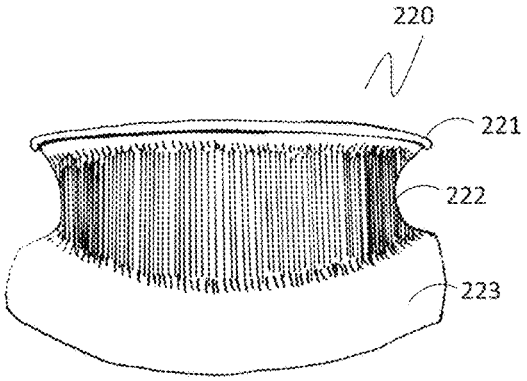
FIG. 1C is a back view of the outer cervical shroud 220 of the embodiment of FIG. 1A, showing the upper flange 221, lower extension 223 and wall 222 of the back portion of the outer cervical shroud 220.
Figure 2C:
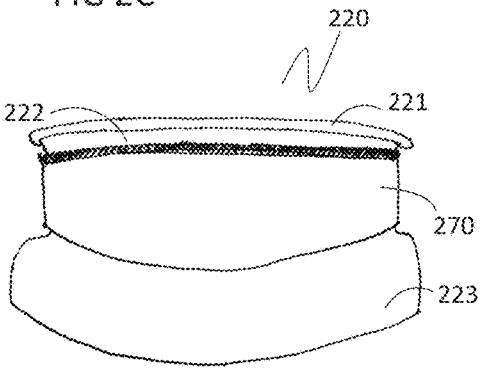
FIG. 2C is a back view of the outer cervical shroud 220 of the embodiment of FIG. 2A, showing the upper flange 221, lower extension 223 and wall 222 of the back portion of the outer cervical shroud 220.
Figure 3A:
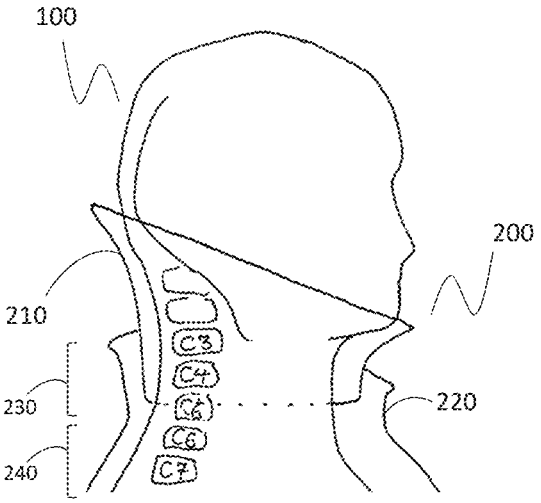
FIG. 3A and FIG. 3B are schematic side views of the articulated cervical shroud assembly 200 of FIG. 1 and FIG. 2, respectively, in cross section positioned on the head of a wearer. Shown is the approximate intended positioning of skull and cervical vertebrae of the wearer within the cervical shroud assembly 200.
Figure 3B:
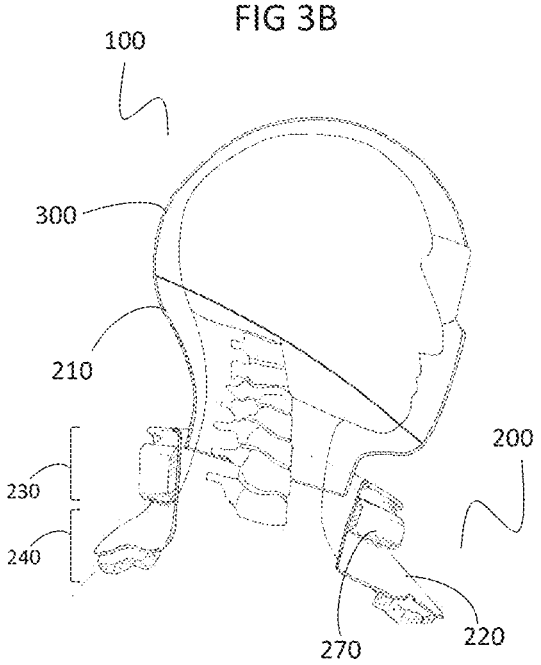

Referring to FIGS. 1A and 1B, the articulated cervical shroud assembly 200 includes:

(a) an inner cervical shroud 210 that is configured to sit substantially around a neck of a wearer (e.g. see FIGS. 3A and 3B). The inner cervical shroud 210 has a funnel portion 211 and a neck portion 212; and (b) an outer cervical shroud 220 that has an upper portion 230 and a lower portion 240. The upper portion 230 is sized to sit concentrically around the neck portion 212 of the inner cervical shroud 210—see e.g. FIGS. 1A and 1B—so that so that the inner cervical shroud 210 is partially nested within the outer cervical shroud 220.

Referring to FIGS. 3A and 3B, the inner cervical shroud 210 is configured to cradle a head of a wearer from below—that is, from roughly the mandible to the occipital bone. This enables movement of the head of the wearer to cause a corresponding movement of the inner cervical shroud 210.

When the inner cervical shroud 210 and the outer cervical shroud 220 are worn together (to form the articulated cervical shroud assembly 200), the neck portion 212 of the inner cervical shroud 210 forms a ball-and-socket style articulation with the upper portion 230 of the outer cervical shroud 220, the ball-and-socket articulation allowing the inner cervical shroud 210 to overlap with the outer cervical shroud 220 for added protection around the neck of the wearer, while permitting movement of the inner cervical shroud 210 relative to the outer cervical 220 shroud in ball-and-socket fashion.

The articulated cervical shroud assembly 200 extends vertically around the neck of the wearer, including at its sides, between an upper plane defined by the occipital bone region and mandible region of the wearer and a lower plane defined by the trapezius muscle region and the pectoral muscle region of the wearer, thereby protecting the neck of the wearer along its full length while permitting movement of the inner cervical shroud 210 relative to the outer cervical shroud 220. This is thanks to the articulation between the inner cervical shroud 210 and the outer cervical shroud 220, which allows the neck of the wearer a full range of movement (as shown in FIGS. 4A and 4B) in any direction—subject to safe limits imposed by the action of the funnel portion 211 of the inner cervical shroud 210 against the upper flange 221 of the outer cervical shroud 220.

Referring to FIGS. 1A to 1C and 2A to 2C, the outer cervical shroud 220 has an upper flange 221 and a lower extension 223, separated by a wall 222. The upper flange 221 travels right around the uppermost periphery (circumference) of the upper portion 230 of the outer cervical shroud 220, from the front portion 250 (see FIGS. 6A and 6B) to the back portion 260 (see FIGS. 6A and 6B) of the outer cervical shroud 220.

The outer cervical shroud 220 has an inclined upper surface that inclines from the front portion 250 to the back portion 260—that is, from the front of the neck to the back of the neck when worn. The inclined upper surface of the outer cervical shroud 220 has a upper flange 221 that makes contact with the inner cervical shroud 210 and progressively or increasingly bites against the funnel portion 211 of the inner cervical shroud as the head of the wearer moves with the inner cervical shroud 210. This progressive biting of the upper flange 221 against the funnel portion 211 progressively limits movement of the inner cervical shroud 210 relative to the outer cervical shroud 220.

Figure 4A:
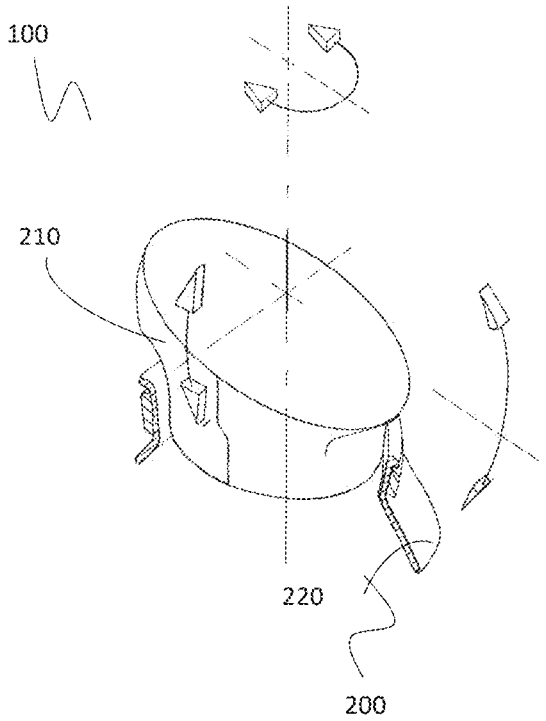
FIG. 4A and FIG. 4B are schematic perspective views of the articulated cervical shroud assembly 200 of FIGS. 1 and 2, respectively, showing the ball-and-socket articulation of the inner cervical shroud 210 with the outer cervical shroud 220.
Figure 4B:
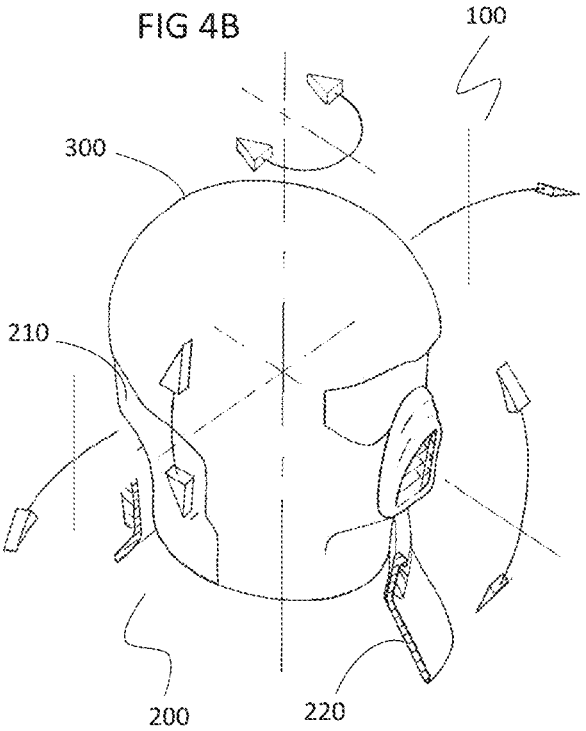
Figure 5A:
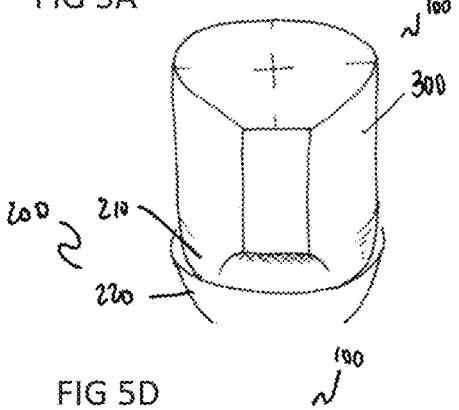
FIG. 5A to 5J are schematic views of the articulated cervical spine and neck protection system 100 showing the articulated cervical shroud assembly 200 of FIG. 2 and FIG. 3 (that is, the embodiments with and without a helmet portion, and with and without projection 270 on the outer cervical shroud 220) drawn schematically to illustrate the ball-and-socket articulation of the inner cervical shroud 210 to the outer cervical shroud 220.
Figure 5B:
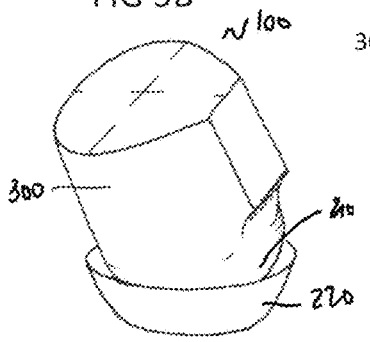
Figure 5C:
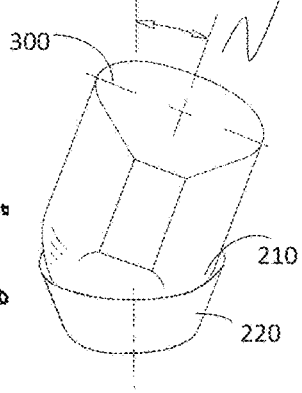
Figure 5D:
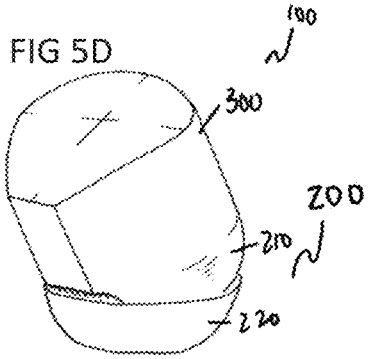
Figure 5E:
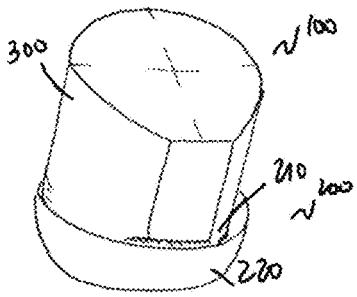
Figure 5F:
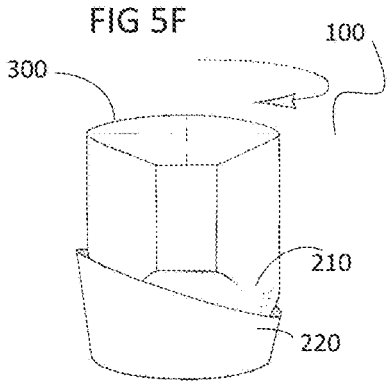
Figure 5G:
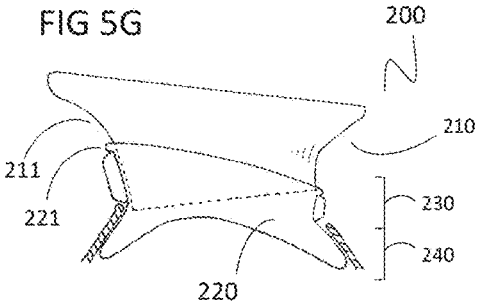
Figure 5H:
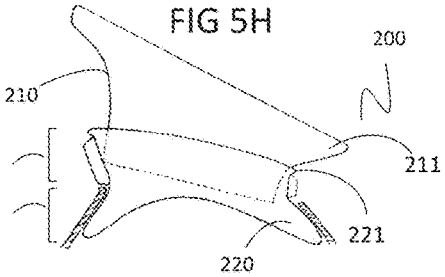
Figure 5I:
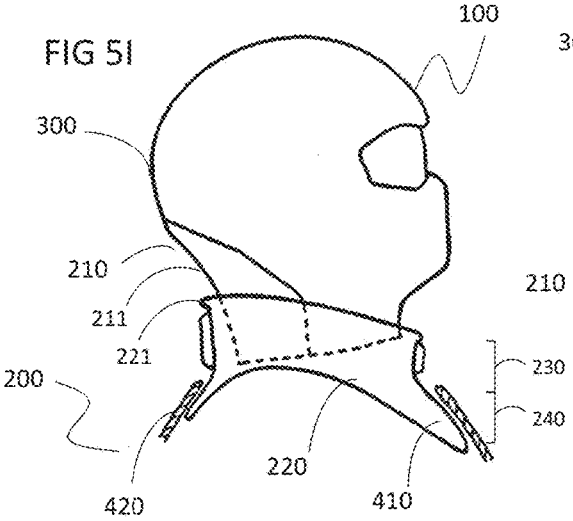
Figure 5J:
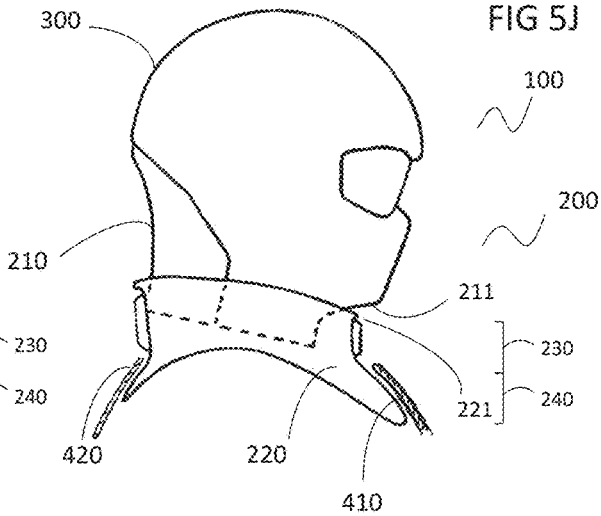

In practice, this means a wearer of the articulated cervical shroud assembly 200 is able to move his or her head substantially in any direction—as shown in FIGS. 4A and 4B. However, when the movement (in any direction) extends towards the outer limits of a safe range, the inclined upper surface of the outer cervical shroud 220 starts to bite or engage increasingly against the inner cervical shroud 210 until no further movement is possible. This is shown schematically in FIGS. 5A to 5J. For example, FIG. 5A is a front view of the articulated cervical spine and neck protection system 100 with the outer cervical shroud 220 and the wearer's head facing forward (shown schematically by the flat surface of a helmet portion facing the viewer). The inner cervical shroud 210 is shown schematically nested within the outer cervical shroud 220. FIG. 5B is the same view as FIG. 5A, but the wearer's head is rotated left at about 80 degrees and tilted right slightly. The inclined upper surface of the outer cervical shroud 220 bites against the funnel portion of the inner cervical shroud 210, progressively resisting the rotational load until the head (within the inner cervical shroud 210) is no longer able to rotate further in a leftward direction. This prevents over-rotation of the neck and cervical spine beyond a safe range, when injury can occur. FIG. 5F is a side view of the articulated cervical spine and neck protection system 100. The angled upper surface of the outer cervical shroud 220 can be seen. The wearer's head is rotated right and stopped at about 90 degrees, which represents the upper limit of safe rotational movement horizontally. FIGS. 5C, D and E are schematic views of the outer cervical shroud 220 limiting flexion of the neck in different directions. FIGS. 5G and 5I show the outer cervical shroud 220 limiting extension (backward tilting) of the neck when the funnel portion 211 hits the upper flange 221 of the inclined upper surface of the outer cervical shroud 220. FIGS. 5H and 5J show the outer cervical shroud 220 limiting flexion (forward tilting) of the neck when the funnel portion 211 hits the upper flange 221 of the inclined upper surface of the outer cervical shroud 220.

FIGS. 5G to 5J also show how the articulated cervical shroud assembly 200 progressively limits axial (compressive) loads. This is achieved by the funnel portion 211 of the inner cervical shroud 210 increasing in diameter so that as it is forced downwards, it progressively increasingly bites against the outer cervical shroud 220—until the inner cervical shroud 210 can no longer move.

The ability to progressively resist loads is an advantage of the articulated cervical spine and neck protection system 100 because sudden limits or stops to movement can result in significant injury (e.g. concussion). Another advantage of the articulated cervical spine and neck protection system 100 is that it is able to resist loads in different directions at the same time (e.g. as drawn schematically in FIG. 5B)—as may occur in real combat or sporting scenarios. Further, the articulated cervical spine and neck protection system 100 allows protection against a load coming from one direction without limiting mobility in another.

The articulated cervical spine and neck protection system 100 also protects against cantilevering of the head over the cervical spine. This is achieved by the nested arrangement of the neck portion 212 of the inner cervical shroud 210 within the upper portion 230 of the outer cervical shroud 220 (e.g. see FIGS. 5G and 7A).

Overlapping of the neck portion 212 of the inner cervical shroud 210 and the upper portion 230 of the outer cervical shroud 220 also has the advantage of providing added protection to the soft tissues of the neck and the cervical spine against forces applied violent attacks (with or without weapons), explosives and/or projectiles from any angle—such as weapon strikes delivered at full force by trained close-quarter combat specialists (such as a rifle butt strike to the throat of an opponent). The articulated cervical spine and neck protection system 100 provides protection along the full length of the neck as long as it is worn, as it does not require activation to trigger protection. Further, because the articulated cervical shroud assembly 200 progressively resists loads, it does not require loads to exceed a threshold before the cervical spine and soft tissues are protected. The more gradual resistance of force is an advantage in movements where organs and bones can continue to move inside the body even when the body stops. Therefore, articulated cervical shroud assembly 200 provides protection against trauma and injury from whiplash-type injuries and also against injuries sustained through the slow application of forces to the soft tissues (arteries, vagus nerve, trachea, larynx or pharynx) of the neck—e.g. arm to arm combat involving grappling with weapons, or strangulation/choking holds as may be encountered by military, law enforcement, corrections or security personnel.

Figure 7A:
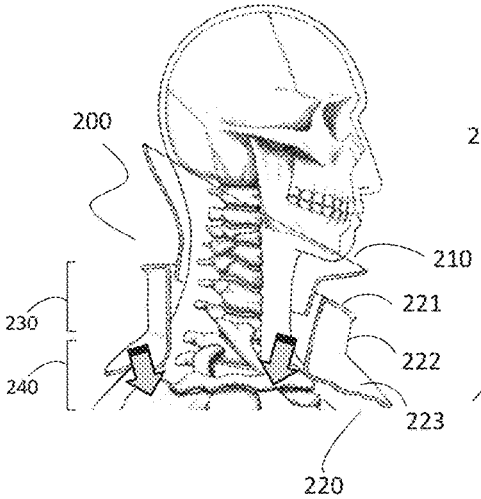
FIG. 7A is a side view of an articulated cervical shroud assembly 200 of the embodiment of FIG. 1 shown in cross section while being worn, showing contact (depicted schematically by the shaded arrows) of the lower portion of the outer cervical shroud 220 with the bone underlying the upper pectoral muscles at the front (namely, the clavicles) and the upper trapezius muscles at the back (namely, the scapulae).
Figure 7B:
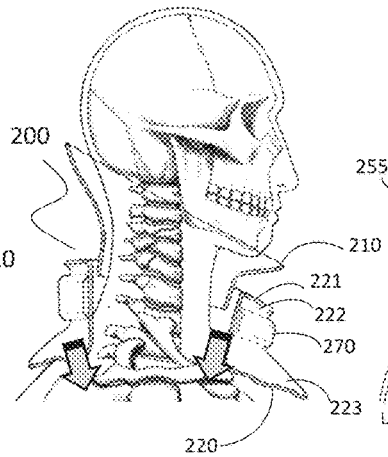
FIG. 7B is a side view of an articulated cervical shroud assembly 200 of the embodiment of FIG. 2 shown in cross section while being worn, showing contact (depicted schematically by the shaded arrows) of the lower portion of the outer cervical shroud 220 with the bone underlying the upper pectoral muscles at the front (namely, the clavicles) and the upper trapezius muscles at the back (namely, the scapulae).
Figure 7C:
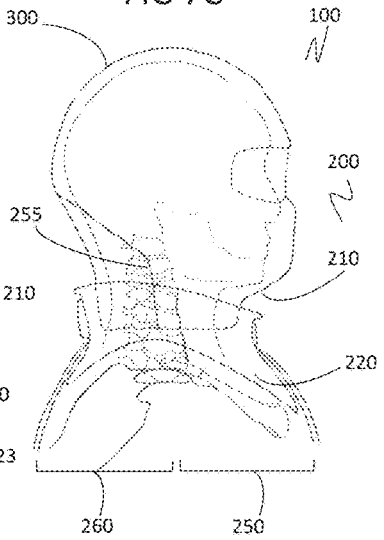
FIG. 7C is a side view of an articulated cervical shroud assembly 200 of the embodiment of FIG. 3B with a helmet portion 300 and shown in cross section while being worn. The lower portion of the outer cervical shroud is shown in position on a wearer with the bone underlying the upper pectoral muscles at the front (namely, the clavicles) and the upper trapezius muscles at the back (namely, the scapulae).
Figure 8A:
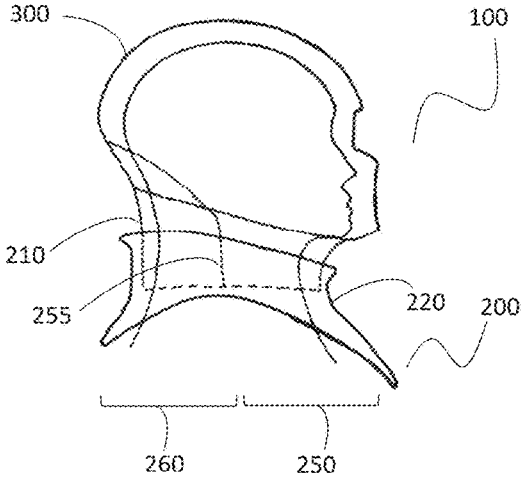
FIGS. 8A and 8B are side views of the articulated cervical spine and neck protection system 100 according to an embodiment, including a helmet portion 300.
Figure 8B:
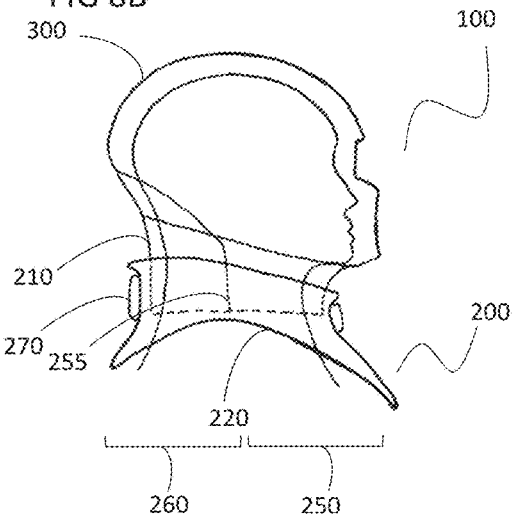
Figure 9A:
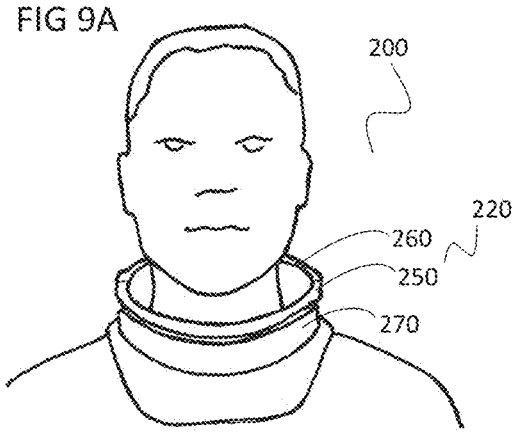
FIGS. 9A and 9B are front and side views, respectively, of an outer cervical shroud 100 of the embodiment of FIG. 2, shown being worn around a neck of a wearer.
Figure 9B:
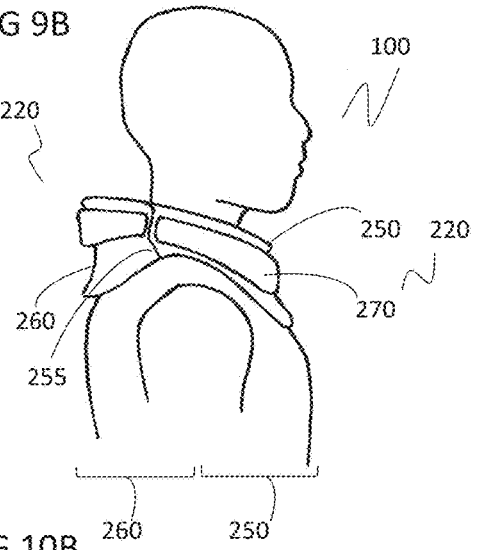

Each of the components of the articulated cervical spine and neck protection system 100 is made of a material with sufficient rigidity to transfer at least some of a force applied to a first component vertically down along the body of a wearer. Referring to FIGS. 7A to 7C, schematic cross sectional views are provided of the articulated cervical spine and neck protection system 100 on the head of a wearer. In FIG. 7A the outer cervical shroud 220 includes a upper flange 221 and a lower extension 223, separated by a wall 222. In FIG. 7B, the outer cervical shroud 220 also includes a projection 270. In FIG. 7C, the inner cervical shroud 210 includes a helmet portion 300 and the outer cervical shroud 220 has the same features as shown in FIG. 7B. When worn, the inner cervical shroud 210 extends from approximately the occipital bone at the back portion 260 to the mandible region at the front portion. The outer cervical shroud 220 extends from the upper to mid cervical spine at the back portion 260 to pectoral muscles at the front portion 250. It can be seen from FIGS. 7A to 7C that the outer cervical shroud 220 is made to extend from the mid-cervical spine down to the pectoral region of a wearer. The inner cervical shroud 210 and outer cervical shroud are made of a sufficiently rigid material so that when a load is applied to the inner cervical shroud 210, it is transferred to the outer cervical shroud 220 and from there to the clavicles and pectoral/trapezius muscles of the wearer.

Figure 12:
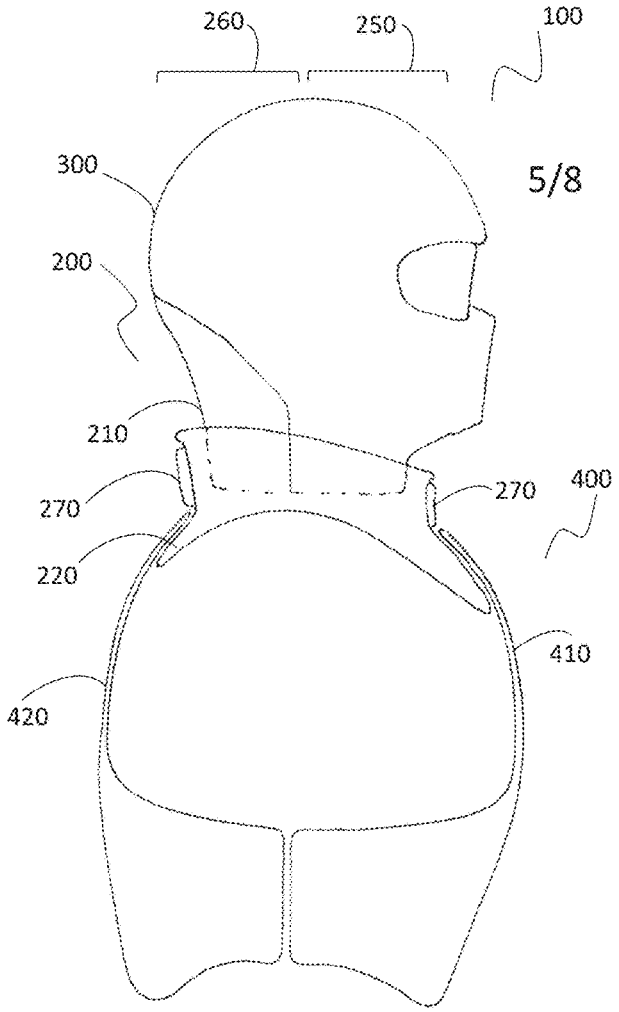
FIG. 12 is a schematic side view in cross section of an articulated cervical spine and neck protection system 100 according to an embodiment. The articulated cervical spine and neck protection system 100 is shown including a helmet portion 300, as well as a chest-and-back plate assembly according to an embodiment.
Figure 11C:
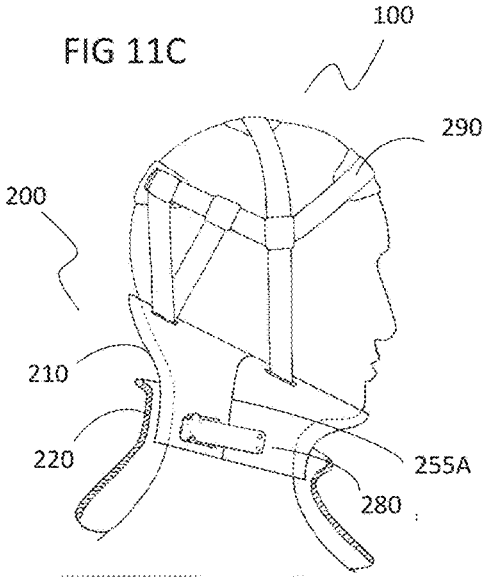

Referring to FIG. 12, in an embodiment, the articulated cervical spine and neck protection system 100 also includes a chest-and-back-plate assembly 400. The chest-and-back-plate assembly 400 includes:

(a) a chest plate 410; and (b) a back plate 420.

Figure 13A:
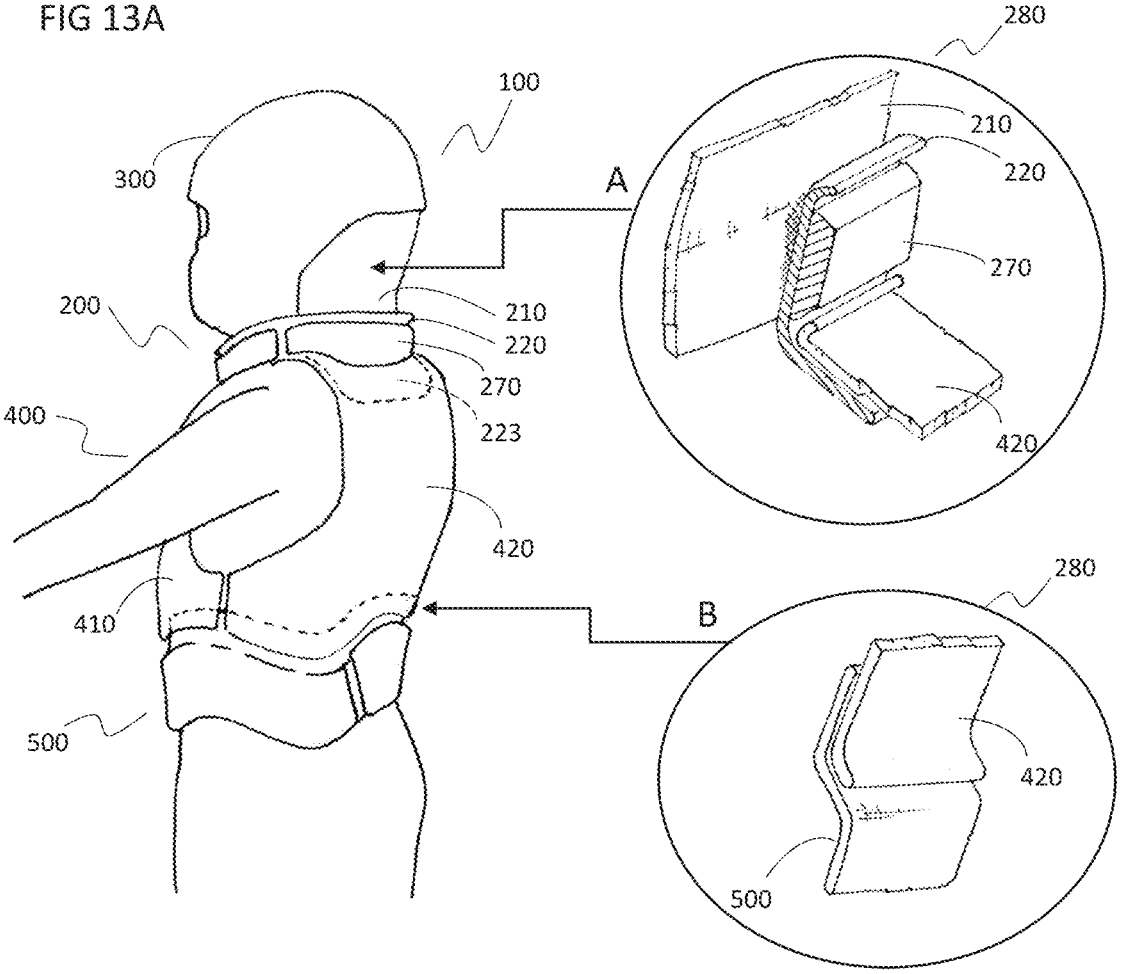
FIG. 13A shows a perspective view of an embodiment of an articulated cervical spine and neck protection system 100 including an articulated cervical shroud assembly 200 with a helmet portion 300, a chest-and-back-plate assembly 400 and a lower torso lumbar belt 500. Inset A and B show close-up cross-sectional views of an articulated coupling means 280 for engaging components of the articulated cervical spine and neck protection system 100.

The chest plate 410 is connected to the front portion 250 of the outer cervical shroud 220 by an articulated coupling means 280. Referring to FIG. 13, the articulated coupling means 280 is made up of overlapping contoured parts. For example, inset A of FIG. 13 shows the articulated coupling means 280 between the back portion of the outer cervical shroud 220 and the back plate 420. The upper part of the back plate 420 overlaps the lower extension 223 of the outer cervical shroud 220 to hold the outer cervical shroud 220 in position. The overlapping engagement means that the back plate 420 can move relative to the outer cervical shroud 220, and that the wearer's back can move relative to the neck. A corresponding articulated coupling means 280 (not illustrated) couples the front portion of the outer cervical shroud 220 and the chest plate 410, securing the front of the outer cervical shroud 220 to the chest plate 410 while allow relative movement between the two. The overlapping engagement also enables downward compression on the ring-like articulated cervical shroud assembly 200 to act upon (load onto) the chest-and-back-plate assembly 400.

The projection 270 of the outer cervical shroud 220 serves two purposes. Firstly, it prevents the back plate 420 and chest plate 410 from moving upwards, so helps retain the chest-and-back-plate assembly 400 in position. Secondly, it provides additional protection against axial (compressive) forces and large magnitude compression. This is because when the inner cervical shroud 210 (with or without a helmet portion 300) is compressed down, the projection 270 is pushed down on the upper edge of the back plate 420 and/or chest plate 410 to transfer the load away from the cervical spine onto the chest-and-back-plate assembly 400 to the lower back and abdomen.

Figure 13B:
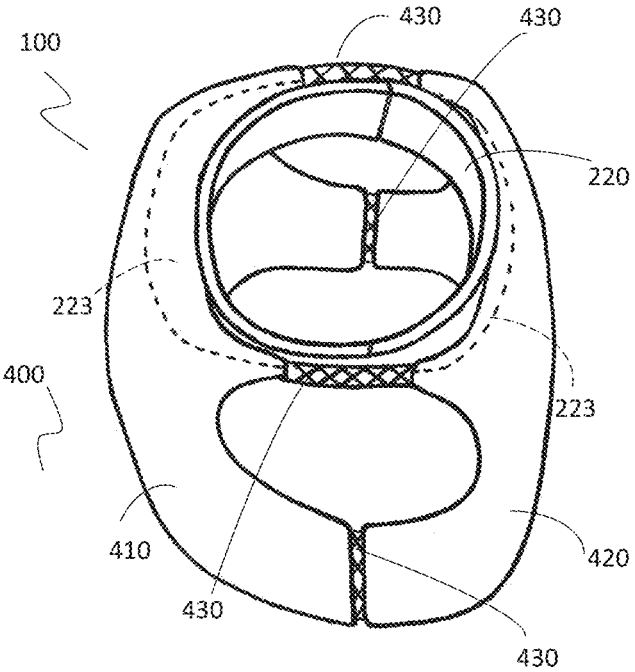
FIG. 13B is an oblique view of the chest-and-back-plate assembly 400 with outer cervical shroud 220 in position.
Figure 13C:
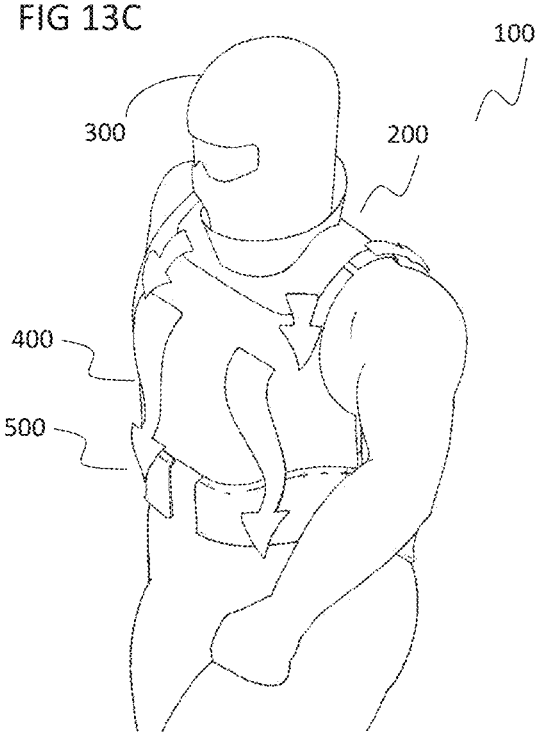
FIG. 13C is a perspective view of the embodiment of FIG. 13A showing the transfer of loads from the cervical spine region to the lower abdomen/lumbar region.

In an embodiment, the articulated cervical spine and neck protection system 100 further includes a lower torso lumbar belt 500 (refer FIG. 13). The lower torso lumbar belt 500 is also secured to the chest-and-back-plate assembly 400 via articulated coupling means 280 (see inset B, FIG. 13). The lower edge of the chest-and-back-plate assembly 400 overlaps the upper edge of the lower torso lumbar belt 500—and is contoured to load onto the uppermost surface of the lower torso lumbar belt 500. This overlapping engagement transfers loads from the chest plate 410 and back plate 420 to the lower torso lumbar belt 500. It also secures the chest-and-back-plate assembly 400 in position, preventing it from moving downward (as it loads onto the uppermost surface of the lower torso lumbar belt 500, and allows relative movement between the two. In use, this means that the wearer is able to move the chest and back relative to the lower abdomen and lumbar region and that axial forces applied to components further up the articulated cervical spine and neck protection system 100 can be transferred vertically down along the body to the lower abdomen and lumbar/hip area. This is shown schematically by the arrows in FIG. 13C, which depicts an embodiment of the articulated cervical spine and neck protection system 100 that includes an articulated cervical shroud assembly 200 with a helmet portion 300, a chest-and-back-plate assembly 400 and a lower torso lumbar belt 500. The arrows show that loads applied to the articulated cervical spine and neck protection system 100 are transferred to lower components of the system 100, away from the more vulnerable cervical spine and neck region.

FIG. 13B is an oblique view, looking down on of the chest-and-back-plate assembly 400 with the outer cervical shroud 220 in position. The lower extension 223 of the outer cervical shroud 220 is shown in ghost under the upper edge of the chest plate 410 and back plate 420. Forces applied to the outer cervical shroud 220 are transferred down to the chest-and-back-plate assembly 400 through the overlapping engagement of the two. Connectors 430 can be seen holding the sides of the chest plate 410 and back plate 420 together. The connectors 430 may be any suitable connection means for securing the plates together to protect the entire torso of the wearer.

Referring to FIGS. 6A, 6B, 8A and 8B the articulated cervical shroud assembly 200 has:

(a) a front portion 250 for positioning at the front of the neck of a wearer; and (b) a back portion 260 for positioning at the back of the neck of a wearer.

Figure 6A:
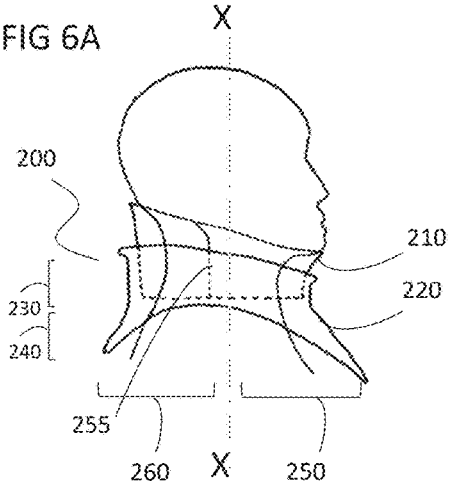
FIG. 6A is a schematic side view of the articulated cervical shroud assembly 200 of FIG. 1 in cross section, showing a front portion 250 and a back portion 260 sitting on either side of a virtual vertical line X-X running parallel to the longitudinal axis of the cervical spine. The front portion 250 of the articulated cervical spine and neck protection system can be substantially removed or separated from the back portion 260, allowing the articulated cervical spine and neck protection system 100 to be opened without tilting of the cervical spine.
Figure 6B:
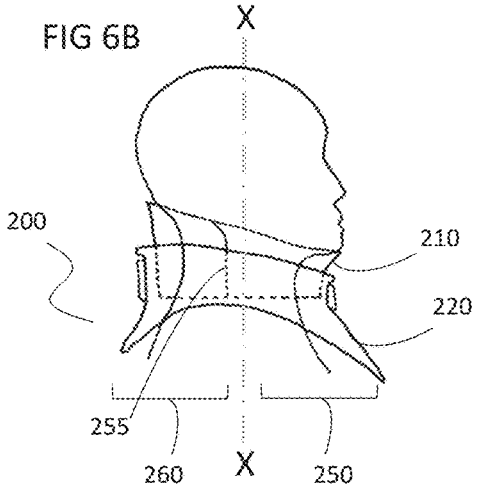
FIG. 6B is a schematic side view of the articulated cervical shroud assembly 200 of FIG. 2 in cross section, showing a front portion 250 and a back portion 260 sitting on either side of a virtual vertical line X-X running parallel to the longitudinal axis of the cervical spine. The outer surface of the outer cervical shroud 220 houses a projection 270. The front portion 250 of the articulated cervical spine and neck protection system can be removed or separated from the back portion 260, allowing the articulated cervical spine and neck protection system 100 to be opened without tilting of the cervical spine.

Each of the inner and outer cervical shrouds 210 and 220, respectively, can be opened and re-closed around the neck by any suitable means, such as a concealed hinge, a mortise and tenon style join or other click fit join or a releasable locking mechanism. A join positioned at an exemplary location on the inner cervical shroud 210 is shown in FIG. 6A, labelled item 255. In this exemplary join 255, the front portion of the outer cervical shroud 220 can be separated from the back portion of the outer cervical shroud 220. In similar fashion, the front portion of the inner cervical shroud 210 can be separated (along a join positioned at line marked 255) can be separated from the back portion of the inner cervical shroud 220.

Figure 10A:
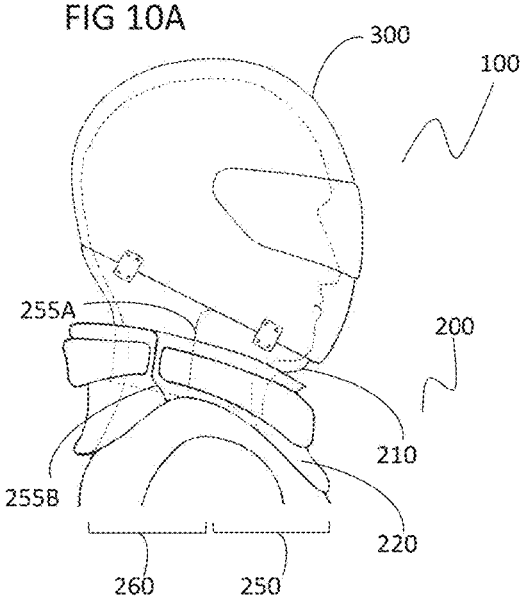
FIG. 10A to 10D are side views of an articulated cervical spine and neck protection system 100 including the cervical shroud assembly 200 of FIGS. 8B and 8A, respectively, being worn.

The advantage of being able to separate the front portion 250 and back portion 260 of the cervical shroud assembly 200 is that it can be readily removed from around the neck of a wearer in the event of distress or injury, without requiring tilting of the neck or cervical spine. This is seen in FIG. 10A, in which the join in the outer shroud assembly 220 is marked item 2558 and the join in the inner shroud assembly 210 is marked item 255A. In an exemplary embodiment, the front portion of each of the articulated inner and outer cervical shrouds 210, 220 are joined to the respective back portions by a mortise and tenon style join and then further secured with a locking device (e.g. see item 280 in FIG. 11B). The locking device 280 may be an outer wrap or strap with Velcro or other suitable fastening around the outside of the articulated cervical shroud assembly 200. The locking device 280 adds additional security and allows a wearer to self load and unwrap the join quickly and without need for tools or strength (e.g. if in distress or injured).

The releasable locking mechanism 280 and reversible join 255 means that the articulated cervical shroud assembly 200 is moveable between an open configuration and a closed configuration for opening and closing around a neck of a wearer. The ability to open the articulated cervical shroud assembly 200 in a vertical plane between a front portion and a back portion is an advantage because it allows removal without tilting of the wearer's head—even when it includes a helmet portion 300. This is especially important when there has been injury or the wearer is in distress or unconscious. Prior art helmets require tilting of neck for removal.

The front portion 250 and back portion 260 sit on either side of a virtual vertical line (marked X-X in FIGS. 6A and 6B) running from the crown of the head down to the base of the neck. The line dividing the articulated cervical shroud assembly 200 in a vertical plane could also run along the line marked 255 in FIG. 6A, or be positioned further forward toward the chin or further back toward the occipital bone.

Figure 11A:
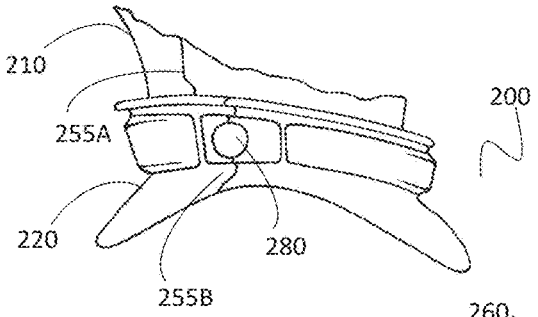
FIG. 11A is a side view of the articulated cervical shroud assembly 200 of FIG. 10D showing a locking device 280 locking the front portion and back portion of the articulated cervical shroud assembly 200 in a closed position.
Figure 11B:
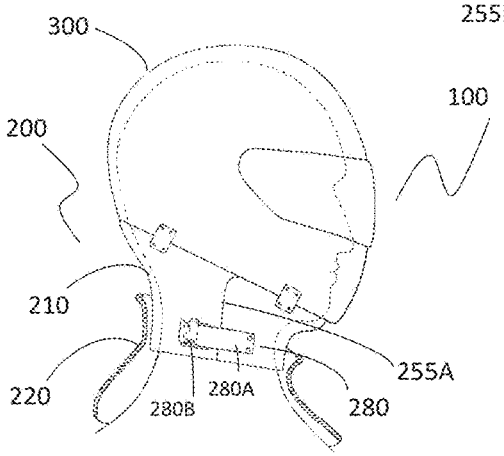
FIGS. 11B and 11C are side views of the articulated cervical shroud assembly 200 of FIGS. 10C and 10D, respectively, showing a locking device 280 on the inner cervical shroud 210 to further secure the front portion and back portion together.

FIG. 11B shows an exemplary embodiment of the reversible locking device 280—a strap 280A with backing made of one part of a hook-and-loop fastener (Velcro), say hooks, and a patch 280B of corresponding loop (or vice versa). Item labelled 280A on the front portion of the inner cervical shroud 210 is one half of the locking mechanism for locking to item labelled 280B on the back portion. When 280A and 280B are connected they form a locking device 280 to further secure the front portion 250 and back portion 260 of the inner cervical shroud 210 together. FIG. 11A shows a different kind of locking device 280—in which an internal click-fit lock is released by a button 280 (depicted as a round button by way of example only).

FIG. 11A is a side view of the articulated shroud assembly 200 (seen from the right side of a wearer) showing join 255 in an exemplary position. The join or opening is marked item 255B in the outer cervical shroud 220, and item 255A in the inner cervical shroud 210. As can be seen, the joins 255A and 255B in each of the inner and outer cervical shrouds 210, 220 do not necessarily align vertically with each other. This is because the ability to open the inner cervical shroud 210 is independent of the ability to open the outer cervical shroud 220 (and vice versa). This allows the entire articulated shroud assembly 200 to be opened easily without tilting the cervical spine. It also allows the outer cervical shroud 220 to be opened and removed independently of the inner cervical shroud 210.

In an embodiment, the articulated cervical shroud assembly 200 will include a securing device 290 (e.g. as shown FIGS. 10B to 10F) to hold the articulated cervical shroud assembly 200 in position. A person skilled in the art will appreciate that the securing device 290 that any suitable securing device may be employed to prevent slippage and/or rotation of the articulated cervical shroud assembly 200.

The helmet portion 300 of the articulated cervical shroud assembly 200 assists to secure the articulated cervical shroud assembly 200 (and the articulated cervical spine and neck protection system 100 more generally) in position on the body. A helmet portion 300 helps prevent the articulated cervical shroud 200 from riding up or down the neck, or rotating around the neck of the wearer. Alternatively or additionally, the articulated cervical shroud 200 can be secured in position on the body by any suitable securing device 290.

Figure 10B:
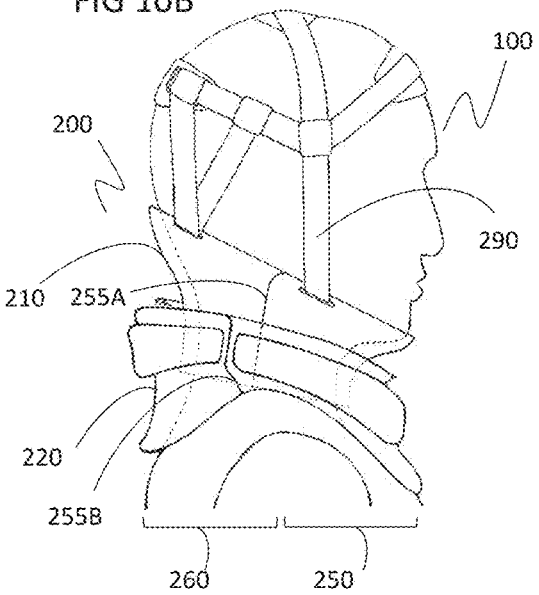
Figure 10C:
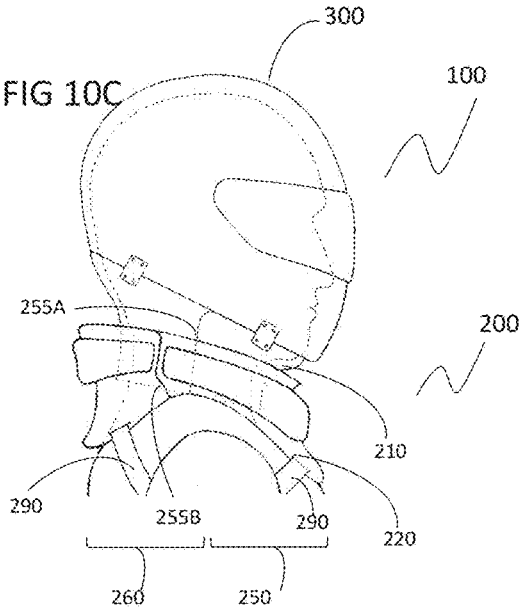

Examples of a suitable securing device 290 include:

(a) a harness that is configured to hold the cervical shroud assembly in position on the torso—for example, under the arms as shown in FIGS. 10C, D, E and F. Depicted is an exemplary securing device 290 in the form of a strap or belt that extends from the front portion 250 of the outer cervical shroud 220 to the back portion 260 of the outer cervical shroud 220, passing under the arms (see FIGS. 10C, D, E and F).

Figure 10D:
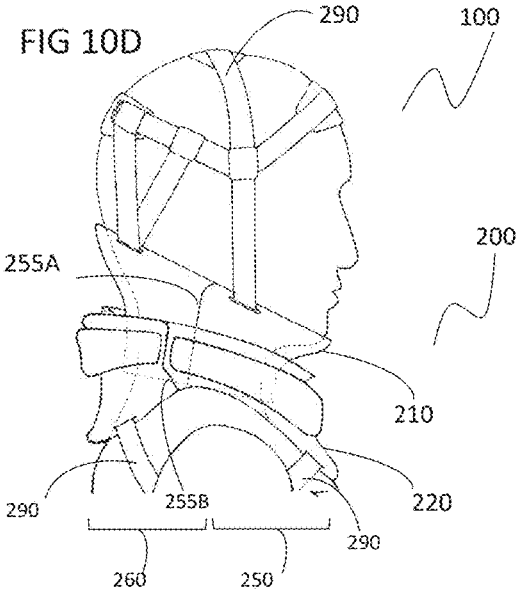
Figure 10E:
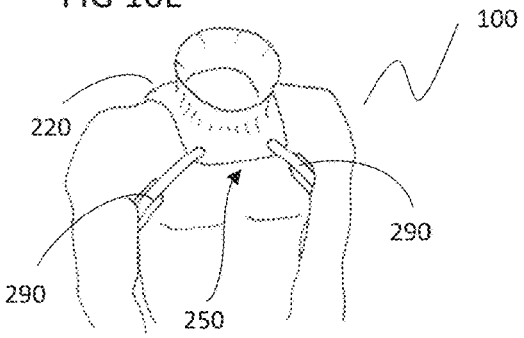
FIGS. 10E and 10F are schematic front and back views, respectively, of the securing device 290 of FIGS. 10C, cervical spine and neck protection system showing front and back views of the securing device 290 on the chest and back, respectively of a wearer.
Figure 10F:
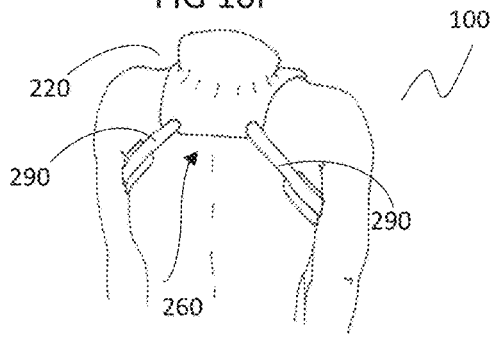

(b) a harness that is configured to hold the cervical shroud assembly in position on the skull. An exemplary securing device 290 in the form of a skull-wrap harness is shown in FIGS. 10B and 10D and passes over the top of the crown of the skull to prevent slippage down from the base of the skull and rotation around the skull that could leave part of the cervical spine unprotected.

In an embodiment, the articulated cervical spine and neck protection system 100 may include a helmet portion 300 that extends over the crown and secures to the inner cervical shroud (e.g. see FIG. 10A), which will also serve to secure the articulated cervical shroud assembly 200 in position on a wearer.

In an embodiment, the articulated cervical spine and neck protection system 100 may also include a chest-and-back-plate assembly 400 (see FIG. 12) attached around an upper torso region of a wearer, to which the articulated cervical shroud assembly 200 is engaged (described above). This will also secure the articulated cervical shroud assembly 200 in position on the wearer's body.

The outer cervical shroud 220 is configured to be worn around the neck (e.g. see FIGS. 6A and 6B), resting on the shoulders of a wearer. Referring to FIGS. 10C and D, the securing device 290 prevents rotation, tilting or slippage of the articulated cervical shroud assembly 200, which is essential to protect the soft tissues of the neck and the cervical spine of the wearer.

Figure 15:
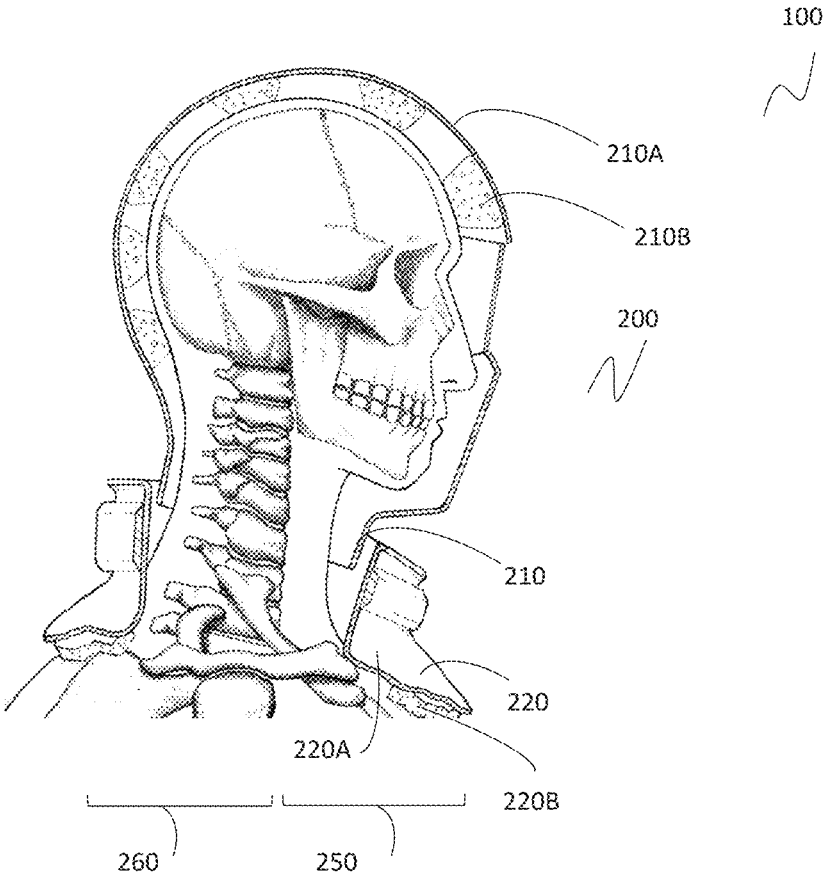
FIG. 15 is a side view of the articulated cervical shroud assembly 200 of FIG. 7B depicting by way of example the exterior surface 210A and interior surface 210B of the inner cervical shroud 210, and the exterior surface 220A and interior surface 220B of the outer cervical shroud 220. The other components of the articulated cervical spine protection system 100 also have inner and outer surfaces.

Referring to FIG. 15, the inner cervical shroud 210 has an interior surface 210B and an exterior surface 210A. The interior surface 210B of the inner cervical shroud 210 may be unlined or may substantially comprise a resilient material capable of deforming—such as memory foam, rubber, sponge, foam, high density polystyrene, silicone, neoprene, vinyl, polyurethane, a urethane foam, pneumatically filled pocket or pocket of air, or a cradle-suspended harness.

The exterior surface (rigid material) 210A of the inner cervical shroud 210 substantially comprises a rigid and puncture resistant or ballistic material such as Kevlar, fiberglass, carbon fibre, thermoplastics and thermoresins, or ultra-high molecular weight polyethylene ballistic fabric or any other ballistic, bulletproof, blast-proof material capable of dispersing force from puncture caused by sharp or blunt weapons, fragments or particles.

Similarly, the other components of the articulated cervical spine protection system 100, including the outer cervical shroud 220, the chest plate 410 and back plate 420, and the lower torso lumbar belt 500 each has an interior surface and an exterior surface. FIG. 15 shows exterior surface 220A and interior surface 22B of the outer cervical shroud 220 by way of example only. The interior and exterior surfaces of other components of the articulated cervical spine protection system 100 have not been illustrated but have the same structure as the outer cervical shroud 220. The interior surfaces may be unlined, or lined (e.g. as shown in FIG. 15) with a resilient material for comfort and additional shock absorption. Suitable resilient materials are as listed above as suitable for the interior surface of the inner cervical shroud 210. The exterior surface substantially comprises a rigid and puncture resistant material (e.g. an ultra-high molecular weight polyethylene ballistic fabric or other suitable ballistic/bulletproof/bomb-proof fabric). Suitable rigid materials are as listed above as being suitable for the exterior surface of the inner cervical shroud.

In an embodiment, the upper portion of the inner cervical shroud 210 also includes a helmet portion 300, as shown in FIG. 11B. The helmet portion 300 extends up from the upper surface 260 of the inner cervical shroud 210 and continues over the crown region of the skull to fully encompass the head of a wearer. The helmet portion 300 itself may be ovoid (e.g. as depicted in FIG. 11B) or any other suitable shape, so long as the base of the helmet portion can engage or connect with the upper portion of the inner cervical shroud 210.

In an embodiment, the articulated cervical shroud assembly does not extend up to include a helmet portion but can be configured to be retro-fitted to a prior art helmet (e.g. as shown in FIG. 10C).

This can be achieved by any suitable securing device to connect the articulated cervical spine and neck protection system 200 to a prior art helmet. Examples include a click-fit, sliding engagement or any other connector or harness mechanism to connect and secure the lower portion of a prior art helmet to the upper surface of the articulated cervical spine and neck protection system 200. A wrap or strap assembly secured with Velcro or other fastening means could also be used to secure the upper surface 260 of the inner cervical shroud 210 to the base of a helmet. The engagement must allow the inner cervical shroud 210 with helmet on top to articulate with the outer cervical shroud 220 so that the outer cervical shroud can limit excess movement beyond the range of functional movement and absorb compressive forces.

Figure 14A:
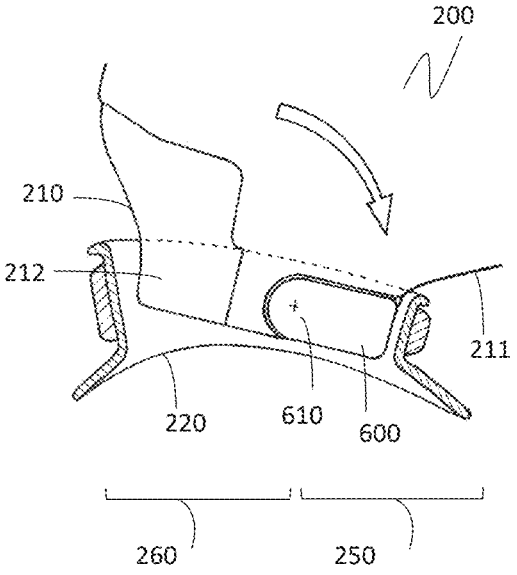
FIGS. 14A and 14B shows side views of an articulated cervical shroud assembly 200 with a deployable throat guard 600 in a closed configuration (FIG. 14A) and an open (deployed) configuration (FIG. 14B).
Figure 14B:
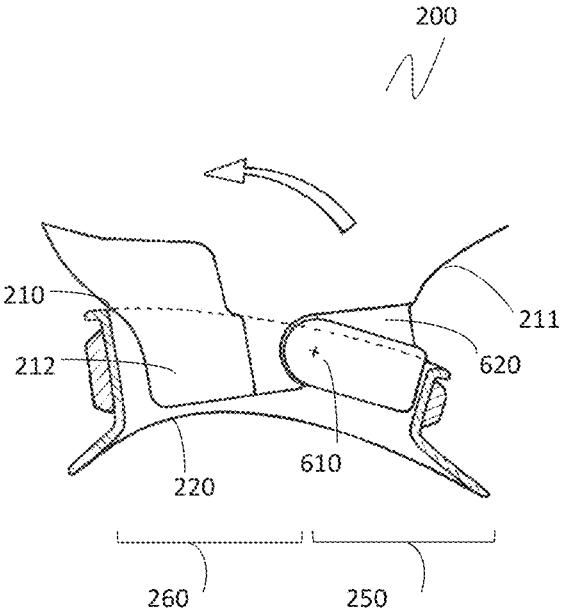

Referring to FIGS. 14A and 14B, in an embodiment, the articulated cervical spine and neck protection system 100 also includes a deployable throat guard 600 extending from side to side around the front of the neck portion 212 of the inner cervical shroud 210. The deployable throat guard 600 provides additional protection from projectile ingress with gross angular articulations if the wearer's neck Is thrown back by excessive forces as may occur in combat.

The throat guard 600 is hingedly engaged (see hinge labelled item 610 in FIGS. 14A and 14B) to each side of the neck portion 212 of the inner cervical shroud 210 and reversibly deployable between an open position (as shown in FIG. 14B) and a closed position (as shown in FIG. 14A) by tilting the throat guard up or down. In the closed position, the throat guard 600 sits flush with the lower portion of the inner cervical shroud 210. In combat, a strike or blow of significant magnitude can cause the head to be thrown back (see, for example, in FIG. 5I and compare with FIG. 14B). This can result in the base of the inner cervical shroud 210 coming close to the uppermost edge of the outer cervical shroud 220 at the front portion 250 of the articulated cervical shroud assembly 200.

To minimise the risk of entry into the throat at the juncture of the inner cervical shroud 210 and outer cervical shroud 220 by a weapon, explosive or projectile when the head is thrown back as far as it will go, the deployable throat guard 600 hinges open (drops down at the front portion of the cervical shroud assembly 200) to reveal another layer of the inner cervical shroud 620 below. This hinging action of the deployable throat guard 600 enables the inner cervical shroud 210 to continue covering the entire length of the wearer's neck—even when the neck is thrown backwards by extreme loads, as may occur in combat scenarios. This is because in the open position, when the inner cervical shroud 210 is extended backwards, the throat guard 600 hinges open (that is, drops down at the front portion 250) so that the entire throat remains covered—even when the neck is extended back as far as the articulated cervical shroud assembly 200 will allow.

An advantage of the articulated cervical spine and neck protection system 100 is that it provides significant protection to the cervical spine and soft tissues of the neck while allowing a full range of functional movement, which is important in weapons-based full force contact martial arts or military, law enforcement, security and corrections combat scenarios requiring protection from violent attacks, explosives and/or projectiles. This is achieved by the articulated cervical shroud assembly 200 being configured to fully encompass the wearer's cervical spine and neck from the base of the skull and jaw to the trapezius and pectoral muscles. The outer cervical shroud 220 is designed to act as a socket to receive the neck portion 212 of the inner cervical shroud 210, the two parts forming an articulated ball and socket join that allows a high degree of unrestricted mobility, whilst progressively limiting or resisting:

(a) downward compression or excessive axial loading;
(b) hyperflexion or excessive forward movement of the neck;
(c) hyperextension or excessive rearward movement of the neck;
(d) lateral hyperflexion or excessive sideways movement of the neck;
(e) excessive rotation of the neck.

The articulated cervical spine and neck protection system also protects against cantilevering of the head forwards or backwards from extreme loads, multiplanar loads and injury or trauma from weapons, explosives or projectiles. This is achieved by overlapping of the inner and outer cervical shrouds 210, 220 made of rigid material to provide added protection to the neck and cervical spine against weapon strikes or projectiles from any angle. The rigid material also enables load transfer away from the cervical spine region to at least the muscles of the chest and back and adjacent clavicles/scapulae. In embodiments that include a helmet portion 300, a chest-and-back-plate assembly 400 and/or a lower torso lumbar belt 500, large magnitude loads can be transferred from the head and cervical spine down to the hips/lumbar region. This is a significant advantage in combat scenarios where extreme forces can be encountered.

The invention thus provides a cervical spine and neck protection system 100 for use in combat and contact sports scenarios, as well as a training device to protect wearers preparing for such scenarios, that overcomes the problems of prior art helmet assemblies in that it provides a full range of functional movement while protecting the soft tissues of the neck and the cervical spine in combat or full contact sport, or provides a useful alternative. However, it will be appreciated that the invention is not restricted to these particular fields of use and that it is not limited to particular embodiments or applications described herein.

Comprises/comprising when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to.

INTERPRETATION

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention. Any one of the terms: including or which includes or that includes as used herein is also an open term that also means including at least the elements/features that follow the term, but not excluding others. Thus, including is synonymous with and means comprising.

Scope of Invention

While there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention. Although the invention has been described with reference to specific examples, it will be appreciated by those skilled in the art that the invention may be embodied in many other forms.

The invention claimed is:

1. An articulated cervical spine and neck protection system for protecting the cervical spine and soft tissues of the neck comprising an articulated cervical shroud assembly made of a rigid material, wherein the articulated cervical shroud assembly includes:

(a) an inner cervical shroud being approximately funnel-shaped and having a funnel portion and a neck portion, wherein the inner cervical shroud is configured to be worn substantially around a neck of a wearer, and wherein the funnel portion of the inner cervical shroud is configured to cradle a head of a wearer from below such that movement of the head of the wearer causes a corresponding movement of the inner cervical shroud, and (b) an outer cervical shroud having an upper portion and a lower portion, wherein the upper portion of the outer cervical shroud includes a wall and is sized to sit concentrically around the neck portion of the inner cervical shroud so that the inner cervical shroud is partially nested within the outer cervical shroud; and wherein when the inner cervical shroud and the outer cervical shroud are worn together, the neck portion of the inner cervical shroud forms a ball-and-socket style articulation with the upper portion of the outer cervical shroud, said ball-and-socket articulation allowing the outer cervical shroud to overlap with the inner cervical shroud for added protection around the neck of the wearer, while permitting movement of the inner cervical shroud relative to the outer cervical shroud in ball-and-socket fashion.

2. The articulated cervical and neck protection system according to claim 1, wherein:

(a) the inner cervical shroud has a front portion and a back portion, the front portion of the inner cervical shroud being configured to extend vertically substantially from a mandible region to a mid-to-lower cervical spine region of a wearer, and the back portion of the inner cervical shroud being configured to extend vertically substantially from an occipital bone region to a mid-to-lower cervical spine region of the wearer, and (b) the outer cervical shroud has a front portion and a back portion, the front portion of the outer cervical shroud being configured to extend substantially from a mid-cervical spine region to a pectoral muscle region of the wearer, and the back portion of the outer cervical shroud being configured to extend substantially from an upper-to-mid cervical spine region to a trapezius muscle region on both sides of the spine of the wearer, such that when assembled together, the articulated cervical shroud assembly is configured to extend vertically around the neck of the wearer, including at its sides, between an upper plane defined by the occipital bone region and mandible region of the wearer and a lower plane defined by the trapezius muscle region and the pectoral muscle region of the wearer, thereby protecting the neck of the wearer along its full length while permitting movement.

3. The articulated cervical and neck protection system according to claim 2, wherein the articulated cervical shroud assembly has a left side portion and a right side portion, each side portion configured to extend vertically from approximately an upper cervical region to a clavicle region of the wearer and its adjacent musculature, wherein each of the left side portion and the right side portion is configured to progressively resist lateral bending of the neck of the wearer, as the funnel portion of the inner cervical shroud progressively engages with the outer cervical shroud, and to transfer forces applied to said side portions to the clavicle region of the wearer and adjacent musculature.

4. The articulated cervical and neck protection system according to claim 2 including:

(a) a chest-and-back-plate assembly comprising:

i. a chest plate configured to extend from a front portion of the outer cervical shroud for substantially a length of an anterior rib cage of the wearer;

ii. a back plate configured to extend from a back portion of the outer cervical shroud for substantially a length of a posterior rib cage of the wearer; and (b) articulated coupling means for coupling the chest-and-back-plate assembly to the lower portion of the outer cervical shroud such that the chest-and-back-plate assembly can move relative to the cervical shroud assembly while being engaged with each other, wherein the chest and back-plate assembly is made of sufficiently rigid material such that contact between the chest-and-back-plate assembly and the cervical shroud assembly transfers some of a force applied to the cervical shroud assembly to the chest-and-back-plate assembly and in turn to underlying bone structure and musculature of the wearer.

5. The articulated cervical and neck protection system according to claim 4 further including:

(a) a lower torso lumbar belt configured to extend from the chest-and-back-plate assembly to a lower torso and lumbar area of the wearer; and (b) articulated coupling means for coupling the lower torso lumbar belt to the chest-and-back-plate assembly such that the lower torso lumbar belt can move relative to the chest-and-back-plate assembly while being engaged with each other, wherein the lower torso lumbar belt is made of sufficiently rigid material such that contact between the chest-and-back-plate assembly and the lower torso lumbar belt transfers some of a force applied to the chest-and-back-plate assembly to the lower torso lumbar belt and in turn to a lower abdominal and lumbar region of the wearer.

6. The articulated cervical and neck protection system according to claim 4, wherein the articulated coupling means comprises:

(a) a first extension, extending downwardly from a first component of the articulated cervical spine and neck protection system, and (b) a second extension, extending upwardly from a second component of the articulated cervical spine and neck protection system wherein the first component and second component are configured in vertical alignment to each other, wherein the first extension overlaps the second extension to engage the first component to the second component while allowing movement of the first component relative to the second component, wherein coupling of the first component to the second component transfers at least some of a force applied to the first component vertically down to the second component such that the articulated cervical spine and neck protection system is configured to transfer at least part of a load from the cervical spine of a wearer to a lower part of a body of the wearer.

7. The articulated cervical protection system according to claim 1, wherein the outer cervical shroud has an inclined upper surface, configured to incline in a direction from a front of the neck to a back of the neck of the wearer when the outer cervical shroud is worn by the wearer, wherein the inclined upper surface of the outer cervical shroud has a top flange, and wherein the top flange of the outer cervical shroud is configured to progressively bite against the funnel portion of the inner cervical shroud as the head of the wearer moves increasingly in one or more of the following directions:

a. bends laterally beyond approximately 20 to 45 degrees to the left or right
b. rotates right or left beyond approximately 70 to 90 degrees around a vertical axis of a cervical spine of the wearer;
c. flexes beyond approximately 70 to 90 degrees in a forward direction;
d. extends beyond approximately 60 to 80 degrees in a backward direction;

such that progressive biting of the top flange of the outer cervical shroud against the funnel portion of the inner cervical shroud progressively limits movement of the inner cervical shroud relative to the outer cervical shroud.

8. The articulated cervical and neck protection system according to claim 1 wherein the funnel portion of the inner cervical shroud progressively increases in diameter relative to the neck portion of the inner cervical shroud such that when the head of the wearer moves downwardly in an axial direction in response to an axial load, the funnel portion of the inner cervical shroud is configured to increasingly bite against the outer cervical shroud, thereby progressively and increasingly resisting axial forces and resultant compression of the cervical spine.

9. The articulated cervical and neck protection system according to claim 1, wherein:

(a) the inner cervical shroud is made of material having sufficient rigidity to transfer at least some of a force applied to it to the outer cervical shroud through contact between the inner cervical shroud and the outer cervical shroud, and
(b) the outer cervical shroud is made of material having sufficient rigidity to transfer at least some of a force applied to it to the trapezius muscle and the pectoral muscle of the wearer through contact between the outer cervical shroud and the trapezius muscles and the pectoral muscles.

10. The articulated cervical and neck protection system according to claim 1, further including a helmet portion, wherein the helmet portion:

(a) is coupled to the funnel portion of the inner cervical shroud, and
(b) is configured to extend at least partially over a crown region of the head of the wearer, and wherein the helmet portion is made of a sufficiently rigid material such that at least some of a force applied to the helmet portion is transferred to the cervical shroud assembly through contact between the helmet portion and the inner cervical shroud of the cervical shroud assembly, and in turn from the inner cervical shroud of the cervical shroud assembly to the outer cervical shroud and in turn from the outer cervical shroud to the trapezius muscles and the pectoral muscles.

11. The articulated cervical and neck protection system according to claim 1, wherein each of the inner cervical shroud and the outer cervical shroud includes a releasable locking mechanism such that the articulated cervical shroud assembly is moveable between an open configuration and a closed configuration for reversibly opening and closing substantially around a neck of a wearer, wherein the releasable locking mechanism allows the cervical shroud assembly to be placed on or removed from the wearer without tilting of the wearer's head.

12. The articulated cervical and neck protection system according to claim 11, wherein the releasable locking mechanism allows removal of the front portion of the outer cervical shroud from the back portion of the outer cervical shroud and removal of the front portion of the inner cervical shroud from the back portion of the inner cervical shroud.

13. The articulated cervical and neck protection system according to claim 11, wherein the releasable locking mechanism is one or more of a hinge, a spring, a latch or an interlocking arrangement of projections and recesses.

14. The articulated cervical and neck protection system according to claim 1 further including a securing device to secure the articulated cervical shroud assembly in position on the wearer.

15. The articulated cervical and neck protection system according to claim 14, wherein the securing device is one or more of the following:

(a) a harness for securing the articulated cervical shroud assembly in position;
(b) a chest- and back-plate assembly attached to an upper torso region of a wearer, to which the articulated cervical shroud assembly is coupled.

16. The articulated cervical protection system according to claim 15, the harness is one or more of:

(a) a harness configured to secure the cervical shroud assembly to a torso of a wearer;
(b) a harness configured to secure the cervical shroud assembly to a skull of a wearer.

17. The articulated cervical protection system according to claim 1, wherein the rigid material is a puncture resistant or ballistic standard protective material to provide a level of protection against projectiles, and other sharp and blunt force impacts and attacks, whether multiple or one-off, attacks or impacts to the same location, not just single attacks or impacts.

18. The articulated cervical and neck protection system according to claim 1 wherein an interior surface of any one or more of the following is lined with a cushioning material for additional shock protection and wearer comfort:

(a) inner cervical shroud
(b) outer cervical shroud
(c) helmet portion
(d) chest plate
(e) back plate
(f) lower torso lumbar belt.

19. The articulated cervical and neck protection system according to claim 18, wherein the cushioning material is any suitable flexible material including one or more of:

(a) rubber
(b) sponge
(c) foam
(d) high density polystyrene
(e) silicone
(f) neoprene
(g) vinyl
(h) polyurethane
(i) urethane foam.

* * * * *